US007445408B2

(12) United States Patent
Stankus et al.

(10) Patent No.: US 7,445,408 B2
(45) Date of Patent: Nov. 4, 2008

(54) YIELDABLE PROP HAVING A RESTRAINT ARRANGEMENT

(75) Inventors: John C. Stankus, Canonsburg, PA (US); John G. Oldsen, Butler, PA (US)

(73) Assignee: Jennmar Corporation, Pittsburgh, PA (US)

( * ) Notice: Subject to any disclaimer, the term of this patent is extended or adjusted under 35 U.S.C. 154(b) by 0 days.

(21) Appl. No.: 11/544,321

(22) Filed: Oct. 6, 2006

(65) Prior Publication Data

US 2007/0031197 A1 Feb. 8, 2007

Related U.S. Application Data

(60) Division of application No. 10/858,621, filed on Jun. 2, 2004, now Pat. No. 7,134,810, which is a continuation-in-part of application No. 10/687,960, filed on Oct. 17, 2003, now Pat. No. 7,114,888, which is a continuation-in-part of application No. 10/371,377, filed on Feb. 21, 2003, now Pat. No. 7,334,968.

(60) Provisional application No. 60/359,089, filed on Feb. 22, 2002, provisional application No. 60/398,290, filed on Jul. 24, 2002, provisional application No. 60/402,281, filed on Aug. 9, 2002.

(51) Int. Cl.
*E21D 15/14* (2006.01)

(52) U.S. Cl. ..... 405/288; 248/354.1

(58) Field of Classification Search ..... 405/288, 405/290, 294; 248/354.1, 354.3–354.7
See application file for complete search history.

(56) References Cited

U.S. PATENT DOCUMENTS 844,385 A 2/1907 Mommertz
949,535 A 2/1910 Hamm
1,584,905 A 5/1926 Symons
1,890,423 A 12/1932 Teagarden
2,068,491 A 1/1937 Jakoubek et al.
2,192,079 A 2/1940 Hinselmann et al.
2,670,170 A 2/1954 Haarmann
3,089,742 A 5/1963 Powell
3,292,892 A * 12/1966 Abbott ..... 248/354.7
3,690,608 A 9/1972 Poizner
3,834,174 A 9/1974 Strumbos
3,870,278 A 3/1975 Lee
4,009,855 A 3/1977 Hoffmann et al.

(Continued)

FOREIGN PATENT DOCUMENTS

EP 0 245 704 A2 4/1987

(Continued)

*Primary Examiner*—Sunil Singh
(74) *Attorney, Agent, or Firm*—The Webb Law Firm

(57) ABSTRACT

A yieldable prop having a hollow first conduit having a first end and an opposite second end, the first end having a conical-shaped interior surface, with interior diameter decreasing as distance from the second end of the first conduit decreases;

a second conduit slidably mounted in the first end of the hollow first conduit;

and at least two discrete engaging members in the first end of the hollow conduit, each of the at least two engaging members engaging the conical-shaped interior surface and outer surface of the second conduit to prevent the second conduit from sliding into the hollow first conduit, while providing for movement of the first and second conduits away from one another.

10 Claims, 16 Drawing Sheets

U.S. PATENT DOCUMENTS

| | | | | | |
|---|---|---|---|---|---|
| 4,234,151 | A | * | 11/1980 | John et al. | 254/98 |
| 4,449,876 | A | | 5/1984 | Glanton | |
| 4,983,077 | A | | 1/1991 | Sorge et al. | |
| 5,015,125 | A | | 5/1991 | Seegmiller | |
| 5,051,039 | A | | 9/1991 | Heiliger | |
| 5,564,867 | A | * | 10/1996 | Domanski et al. | 405/290 |
| 5,583,288 | A | | 12/1996 | Brenner et al. | |
| 5,720,581 | A | | 2/1998 | Bacon et al. | |
| 5,967,702 | A | | 10/1999 | Vogelzang | |
| 6,234,541 | B1 | | 5/2001 | Wagner et al. | |
| 6,409,139 | B1 | | 6/2002 | Du Pree | |
| 6,481,052 | B1 | | 11/2002 | Beall | |
| 6,571,426 | B2 | | 6/2003 | Chen | |

FOREIGN PATENT DOCUMENTS

| | | | |
|---|---|---|---|
| GB | 2 209 549 | A | 5/1989 |
| GB | 2 260 559 | A | 4/1993 |

* cited by examiner

YIELDABLE PROP HAVING A RESTRAINT ARRANGEMENT

CROSS REFERENCE TO RELATED APPLICATION

This application is a divisional of U.S. patent application Ser. No. 10/858,621 filed Jun. 2, 2004, now U.S. Pat. No. 7,134,810, which is a continuation-in-part of U. S. patent application Ser. No. 10/687,960 filed Oct. 17, 2003, now U.S. Pat. No. 7,114,888, which is a continuation-in-part of U.S. patent application Ser. No. 10/371,377 filed Feb. 21, 2003, now U.S. Pat. No. 7,334,968, which claims the benefit of U.S. Provisional Patent Application Nos. 60/359,089, filed Feb. 22, 2002; 60/398,290, filed Jul. 24, 2002; and 60/402,281, filed Aug. 9, 2002.

BACKGROUND OF THE INVENTION

1. Field of the Invention

The present invention relates to mine roof props and, more particularly, to a yieldable mine roof prop having two telescoping conduits, a clamp assembly, and a yield section having a collapsible insert.

2. Brief Description of the Prior Art

A mine roof support system having two yielding props connected to one another by a support cross member is known. The yieldable props in the known mine roof support system each include a clamp assembly which includes a clamp having a first split conduit, a second split conduit, at least one U-shaped bolt, an arch-shaped brace, and internally threaded nuts.

In one arrangement of a yieldable prop, an inner conduit is slidably mounted into an outer conduit and held in position by a clamp assembly. As a compression load, e.g., a shifting mine tunnel roof, acts on the prop, the first tube slides into the second tube. Although this is acceptable, there are limitations, e.g., the force of the clamp assembly controls the load that the prop can take before it compresses. Because the props are usually manually set and the clamp assembly manually adjusted in the mines, there is a variation in the compressive load each prop can support before collapsing.

It would be advantageous to provide a yieldable prop that does not have the limitations of the available yieldable props.

SUMMARY OF THE INVENTION

This invention relates to a yieldable prop having a hollow conduit defined as a first conduit. The first conduit having a first end and a second opposite end, and a yield section mounted at one of the ends of the first conduit. In one non-limiting embodiment of the invention, the yield section includes a plate; an outer sleeve having a first end and a second opposite end, the first end of the sleeve mounted on a surface of the plate; a pipe having a first end, a second opposite end, and a body between the first end and the second end of the pipe, the first end of the pipe mounted on the surface of the plate within the outer sleeve, with the outer surface of the pipe spaced from the inner surface of the outer sleeve to provide a space between the pipe and the outer sleeve, and an insert in the space. One of the ends, e.g., the first end, of the conduit is slidably received in the space, with the insert between the surface of the plate and the first end of the conduit.

In one non-limiting embodiment of the invention, the yield section is at the first end of the first conduit, the plate is a first plate, and further including a second conduit having a first end and an opposite second end, with the first end of the second conduit slidably received in the second end of the first conduit. A surface of a second plate is mounted on the second end of the second conduit and a securing arrangement maintains the first and second plates in a predetermined spaced relationship to one another. The first conduit can support a predetermined compression load before collapsing; the second conduit can support a predetermined compression load before collapsing; the insert can support a predetermined compression load before collapsing; and the predetermined compression load of the insert is less than the predetermined compression load of the first and second conduits.

In a further non-limiting embodiment of the invention, a first spacer is between the first end of the first conduit and the insert, and a second spacer is between the insert and the surface of the plate. The first and second spacers have a wall thickness and outside diameter greater than the wall thickness and outside diameter of the insert, and the first spacer has a wall thickness and outside diameter equal to or greater than the wall thickness and outside diameter, respectively, of the first conduit.

In another non-limiting embodiment of the invention, the securing arrangement is selected from the group consisting of (1) a sliding compression clamp comprising a housing having a first side, a second opposite side, a passageway extending from the first side to the second side with opening of the passageway decreasing as the distance from the first side of the housing increases, the housing securely mounted on the first conduit adjacent the second end of the first conduit with the first side of the housing facing the second conduit, and a compressing member mounting the outer surface of the second conduit and mounted in the passageway; and (2) a clamp assembly comprising two C-shaped pieces mounted on the outer surface of the second conduit and contacting the second end of the first conduit, and one or more clamps mounting the two C-shaped pieces and securely mounting them to the outer surface of the second conduit.

The invention further relates to a yieldable prop having a hollow first conduit having a first end and a second opposite end, a second conduit slidably received in the second end of the first conduit, a compression clamp, and a yield section. The compression clamp secures the first and second conduits in a fixed relationship to one another and includes a housing having a first side, a second opposite side, and a passageway extending from the first side to the second side, with the opening of the passageway decreasing as the distance from the first side of the housing increases. The housing is securely mounted on the first conduit adjacent the second end of the first conduit, with the first side of the housing facing the second conduit. A compressing member mounts the outer surface of the second conduit and mounted in the passageway.

In one non-limiting embodiment of the invention, the yield section includes an outer sleeve having a first end and a second opposite end, the first end of the sleeve mounted to the second surface of the housing, an inner surface of the outer sleeve spaced from outer surface of the second conduit to provide a space therebetween for receiving an insert. The second end of the first conduit is slidably received in the space, with the insert between the second surface of the housing and the second end of the first conduit.

In another non-limiting embodiment of the invention, the first and second conduits can support a predetermined compression load before collapsing, the insert can support a predetermined compression load before collapsing, and the predetermined compression load of the insert is less than the predetermined compression load of the first conduit and of the second conduit.

In a further non-limiting embodiment of the invention, a first spacer is provided between the second end of the first conduit and the insert, and a second spacer is provided between the insert and the second surface of the housing. The first and second spacers have a wall thickness and outside diameter greater than the wall thickness and outside diameter of the insert, and the first spacer has a wall thickness and outside diameter equal to or greater than the wall thickness and outside diameter, respectively, of the first conduit.

In a still further non-limiting embodiment of the invention, the second conduit is a second hollow conduit and further compressing a third conduit in the second conduit and having one end mounted to the second bearing plate and having a length sufficient to extend from the second bearing plate to a position between the first bearing plate and the yield section.

DETAILED DESCRIPTION OF THE INVENTION

Figure 1:
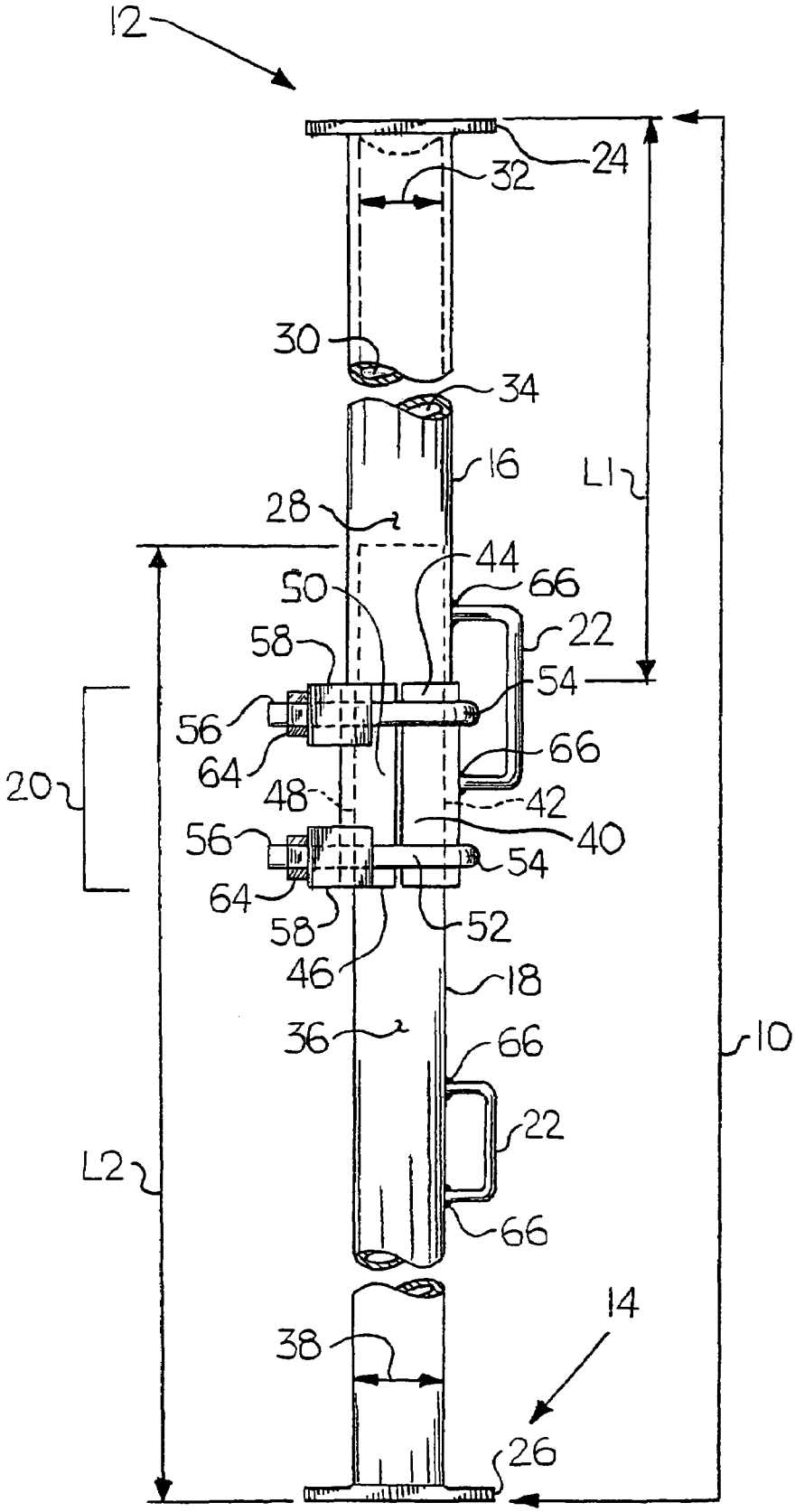
FIG. 1 is a side view of a first embodiment of a yieldable prop according to the present invention.

In the following discussion of non-limiting embodiments of the invention, spatial or directional terms, such as "inner", "outer", "left", "right", "up", "down", "horizontal", "vertical", and the like, relate to the invention as it is shown in the drawing figures. However, it is to be understood that the invention can assume various alternative orientations and, accordingly, such terms are not to be considered as limiting. Further, all numbers expressing dimensions, physical characteristics, and so forth, used in the specification and claims are to be understood as being modified in all instances by the term "about". Accordingly, unless indicated to the contrary, the numerical values set forth in the following specification and claims can vary depending upon the desired properties sought to be obtained by the practice of the invention. At the very least, and not as an attempt to limit the application of the doctrine of equivalents to the scope of the claims, each numerical parameter should at least be construed in light of the number of reported significant digits and by applying ordinary rounding techniques. Moreover, all ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more and ending with a maximum value of 10 or less, and all subranges in between, e.g., 1 to 6.3, or 5.5 to 10, or 2.7 to 6.1.

Further, in the discussion of the non-limiting embodiments of the invention, it is understood that the invention is not limited in its application to the details of the particular non-limiting embodiments shown and discussed since the invention is capable of other embodiments. Further, the terminology used herein is for the purpose of description and not of limitation and, unless indicated otherwise, like reference numbers refer to like elements.

As shown in FIG. 1, a yieldable prop 10 according to the present invention has a first end 12, a second end 14, a first conduit 16, a second conduit 18, a first clamp assembly 20, at least one handle 22, and optional first and second bearing plates 24, 26. The first conduit 16 is preferably a cylindrical hollow pipe, such as a nominal three and one-half inch schedule 40 pipe, a nominal three inch schedule 40 pipe, a nominal three inch schedule 80 pipe, or a two and one-half inch schedule 40 pipe, defining a first outer surface 28 and a first inner surface 30, with the first inner surface 30 further defining a first inner diameter 32, and a first hollow cavity 34. The second conduit 18 is preferably also a cylindrical hollow or solid pipe having a second outer surface 36 which defines a second outer diameter 38. Both the first and second conduits 16, 18 are each preferably made from metal, such as steel, having a wall thickness of approximately ⅛ to ¾ inch. The handle 22 is preferably attached to the first clamp assembly 20 and the first conduit 16 to help prevent the clamp assembly 20 and the prop 10 from becoming disassembled during shipping or handling.

The second conduit 18 is slidably positioned in the first hollow cavity 34 defined by the first conduit 16 in a telescoping relationship. Therefore, the second outer diameter 38 of the second conduit 18 is less than the first inner diameter 32 of the first conduit 16.

Although cylindrically-shaped conduits (pipes) are preferred, alternatively-shaped conduits are also contemplated. Moreover, for reasons discussed below, it has been discovered that a first length L1 and a second length L2 should be selected as a function of seam height to obtain maximum benefits and allow for maximum overlap of the first conduit 16 and second conduit 18 when the conduits are fully nested together.

Figure 2:
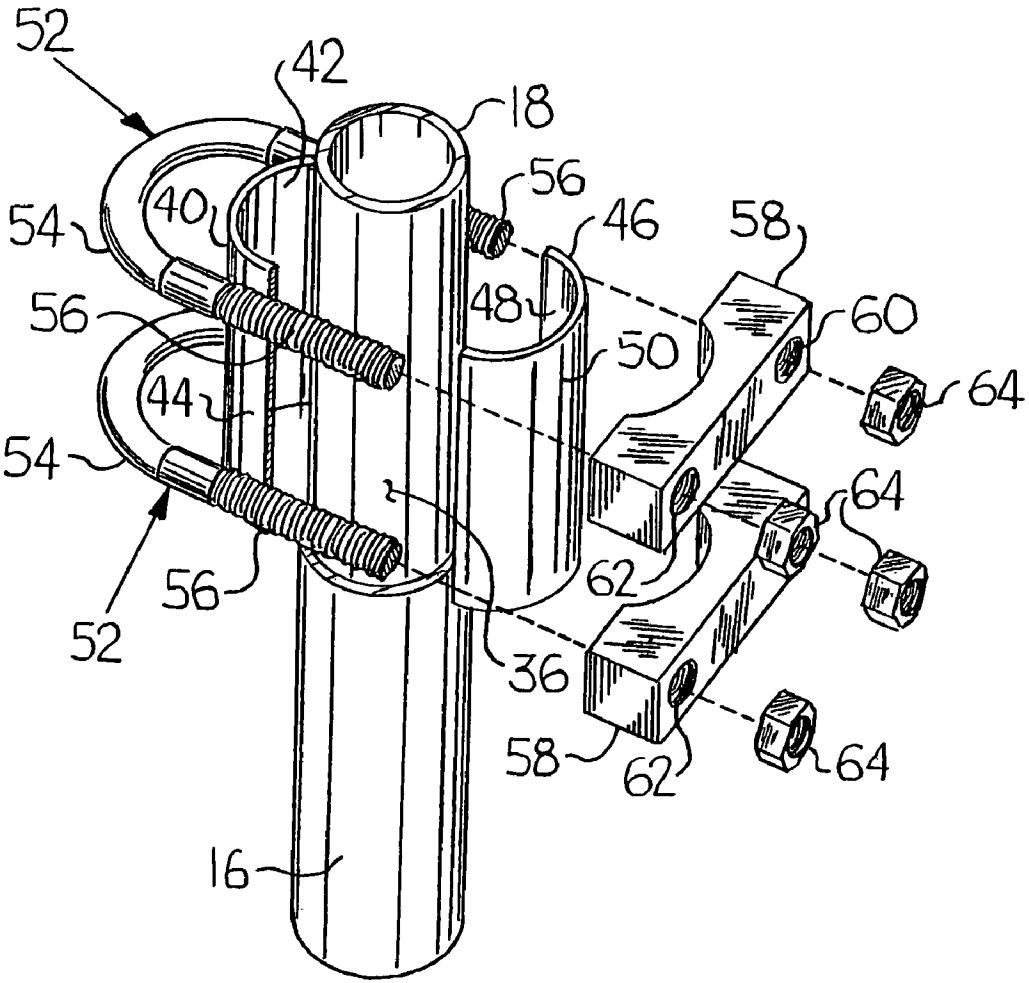
FIG. 2 is an exploded top perspective view of a first clamp assembly according to the present invention.

The first clamp assembly 20 is positioned adjacent to the second outer surface 36 of the second conduit 18. As shown in FIGS. 1 and 2, the first clamp assembly 20 preferably includes a first split conduit 40 defining a first split inner surface 42 and a first split outer surface 44, a second split conduit 46 defining a second split inner surface 48 and a second split outer surface 50, and at least one bolt 52 having an outer surface compatible with an outer shape of the conduit used. Because cylindrically-shaped conduits are shown, the bolt 52 has a U-shaped portion 54 and two threaded legs 56. A brace having an outer surface compatible with an outer shape of the conduit used, such as an arch-shaped brace 58, defines first and second leg orifices 60, 62 (FIG. 2 only). Two internally threaded nuts 64 individually engage each threaded leg 56, and hardened or frictionless washers (not shown) may also be used in conjunction with the threaded nuts 64. The frictionless washers aid in torquing the threaded nuts 64. The first split conduit 40 and the second split conduit 46 are each preferably made from metal, such as steel, having a thickness of approximately ⅛ to ¾ inch. The U-shaped bolt or bolts 52, the arch-shaped brace 58, and the internally threaded nuts 64 are also preferably made from metal or other suitable material.

Figure 3:
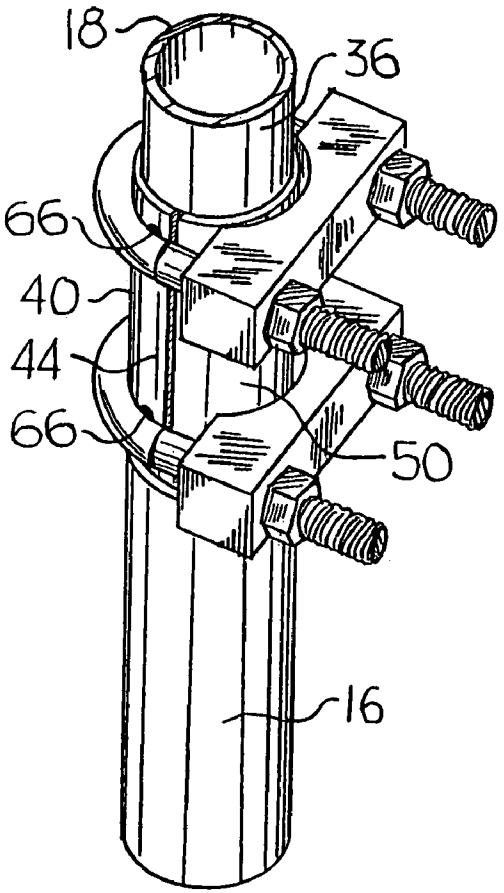
FIG. 3 is a perspective view of the first clamp assembly shown in FIG. 2.

As shown generally in the combination of FIGS. 2 and 3, the first split inner surface 42 of the first split conduit 40 and the second split inner surface 48 of the second split conduit 46 are each, respectively, positioned partially around the second outer surface 36 of the second conduit 18. The U-shaped portion 54 of the U-shaped bolt or bolts 52 is positioned adjacent to the first split outer surface 44 of the first split conduit 40. Each threaded leg 56 of each U-shaped bolt 52 extends through the respective first or second leg orifices 60, 62 defined by the arch-shaped brace 58. When the threaded nuts 64 are tightened in the conventional manner, such as by clockwise rotation, the U-shaped portion 54 of the U-shaped bolt 52 exerts a force on the first split conduit 40, while the arch-shaped brace 58 exerts a force on the second split conduit 46. In turn, the first and second split conduits 40, 46 each exert a force on the second outer surface 36 defined by the second conduit 18.

Because the first clamp assembly 20 is a combination of pieces, the first clamp assembly 20 can be vibrated loose during shipping. To solve this problem, as shown in FIG. 3, the U-shaped portion 54 of the U-shaped bolt or bolts 52 is tack welded 66 or otherwise attached to the first split conduit 40. As shown in FIG. 1 and as discussed above, a handle 22 may also be tack welded 66 or otherwise connected to both the first conduit 16 and the clamp assembly 20.

Referring to FIG. 1, the first and second bearing plates 24, 26 may be flat plates (26) welded to opposing ends of the yieldable prop 10 or non-attached, self-seating dome or volcano-type plates (24), which adjust for an uneven mine roof or mine tunnel floor or any combination herein described. Other types of bearing devices may also be used. For example, a C-shaped channel can be used to abut a roof beam. The readily detachable dome or volcano-type plates are advantageous because they allow the prop 10 to be easily dragged or otherwise handled within the cramped confines of a mine tunnel. Weight of the prop 10 is also reduced.

Figure 4:
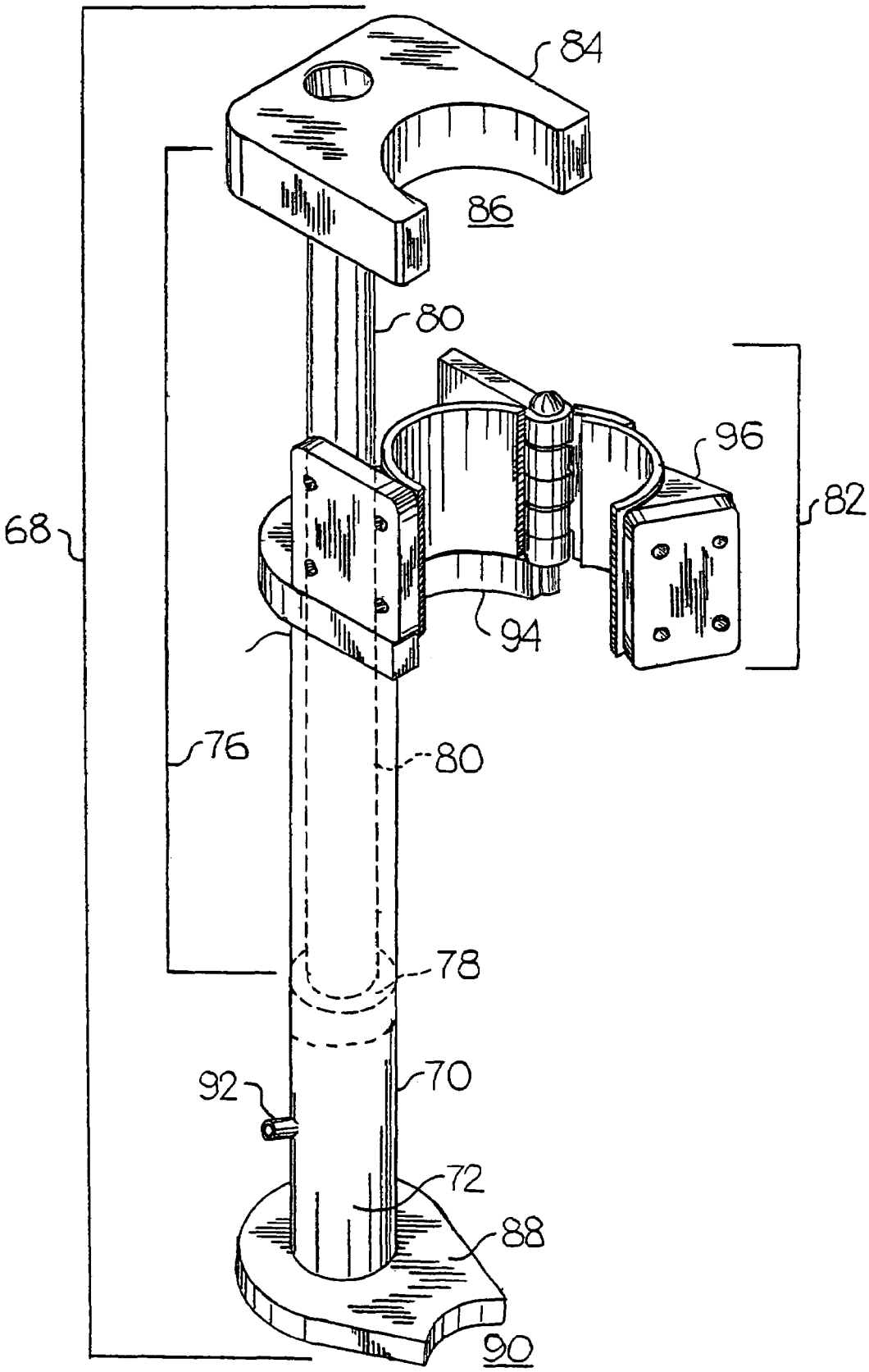
FIG. 4 is a top perspective view of a first embodiment jack assembly.

Because the yieldable prop 10 is adjustable in overall height due to the telescoping arrangement of the first conduit 16 and the second conduit 18, a jack assembly 68 is used to adjust the overall height or length of the yieldable prop 10. One suitable jack assembly 68 is shown in FIG. 4. The jack assembly 68 generally includes a jack body 70 having a first jack end 72 and a second jack end 74, a piston 76 having a plunger 78 and a piston arm 80, a jack clamp 82, a base 84 defining a first partial orifice 86, and a guide 88 defining a second partial orifice 90. The jack body 70 has a fluid inlet opening 92 and further houses the plunger 78 of the piston 76. The piston arm 80 is partially housed in the jack body 70 and partially extends away from the second jack end 74 of the jack body 70. The guide 88 is positioned adjacent to the first jack end 72 of the jack body 70. The base 84 is positioned at the other end of the piston arm 80, opposite the plunger 78. The second clamp assembly 82 is positioned on the second jack end 74 of the jack body 70.

In the preferred embodiment, the piston 76 is pneumatically or hydraulically driven. When a force is exerted on one side of the plunger 78, the piston arm 80 extends away from the jack body 70. When the force is removed or if force is applied to the other side of the plunger 78, the piston arm 80 retracts into the jack body 70.

Figure 5:
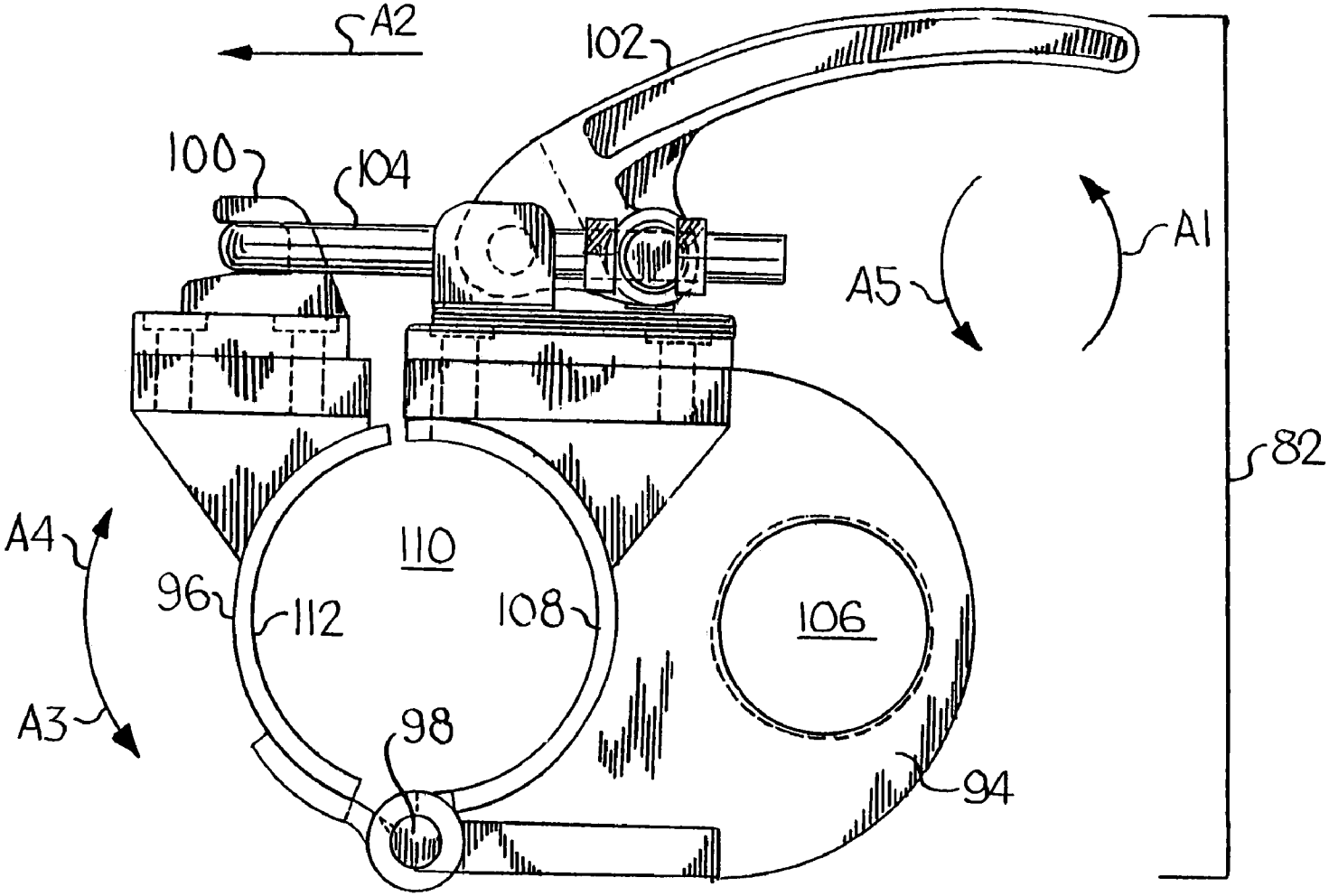
FIG. 5 is a top view of a jack clamp shown in FIG. 4.

FIG. 5 shows the jack clamp 82 in greater detail. The jack clamp 82 may include a clamp plate 94, a pivot arm 96, a pivot pin 98, a hook 100, a second handle 102, and a latch bar 104. The clamp plate 94 defines a clamp orifice 106 which, referring also to FIG. 4, receives the second jack end 74 of the jack body 70 and permits the piston arm 80 to pass through the clamp plate 94. The clamp plate 94 further defines one section 108 of a partial second conduit orifice 110. The pivot arm 96, pivotally connected to the clamp plate 94 via the pivot pin 98, defines another section 112 of the partial second conduit orifice 110. The hook 100 is attached to the pivot arm 96, the second handle 102 is pivotally attached to the clamp plate 94, and the latch bar 104 is connected to the second handle 102.

When the second handle 102 is moved in a first direction, indicated by arrow A1, the latch bar 104 moves in a second direction, indicated by arrow A2, which allows the latch bar 104 to clear the hook 100. This allows the pivot arm 96 to pivot in the third or fourth directions, as indicated by arrows A3 and A4, about pivot pin 98. When the pivot arm 96 is moved in the fourth direction A4, the latch bar 104 can be positioned in engagement with the hook 100, and the second handle 102 may be moved in a fifth direction, indicated by arrow A5, thus releasably clamping the second clamp assembly 82 around the second conduit 18.

Figure 6:
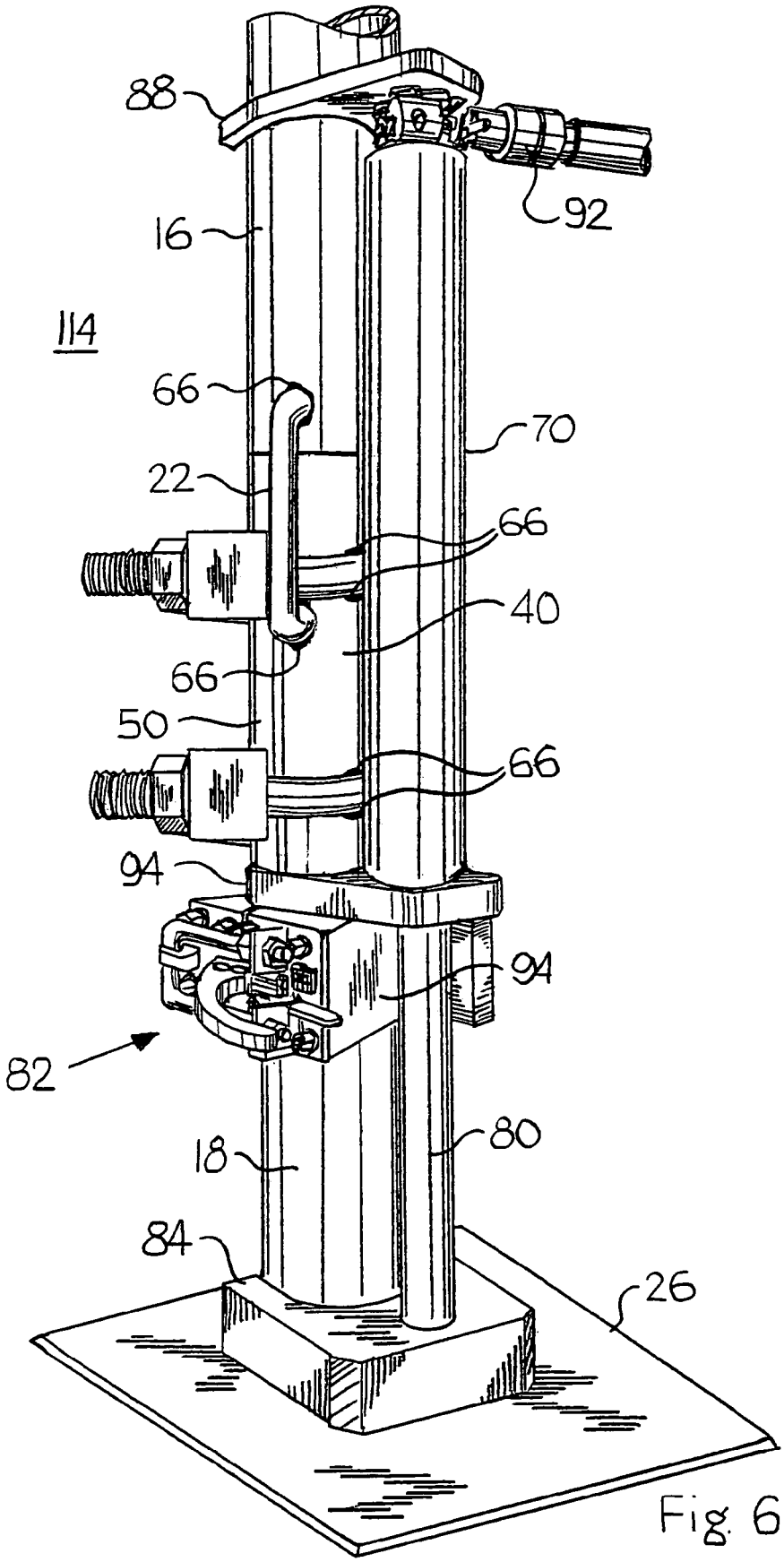
FIG. 6 is a perspective side view of the first embodiment yieldable prop shown in FIG. 1, with the first embodiment jack assembly shown in FIG. 4 removably attached thereto.

One method of installing the yieldable prop 10 will now be discussed. In an installation mode, as shown in FIG. 6, the yieldable prop 10 is positioned horizontally on a support surface 114, such as a mine tunnel floor. The jack assembly 68 is then removably connected to the yieldable prop 10 via the jack clamp 82. The guide 88 partially encompasses the first conduit 16. The base 84 is positioned adjacent to the second bearing plate 26.

Figure 7:
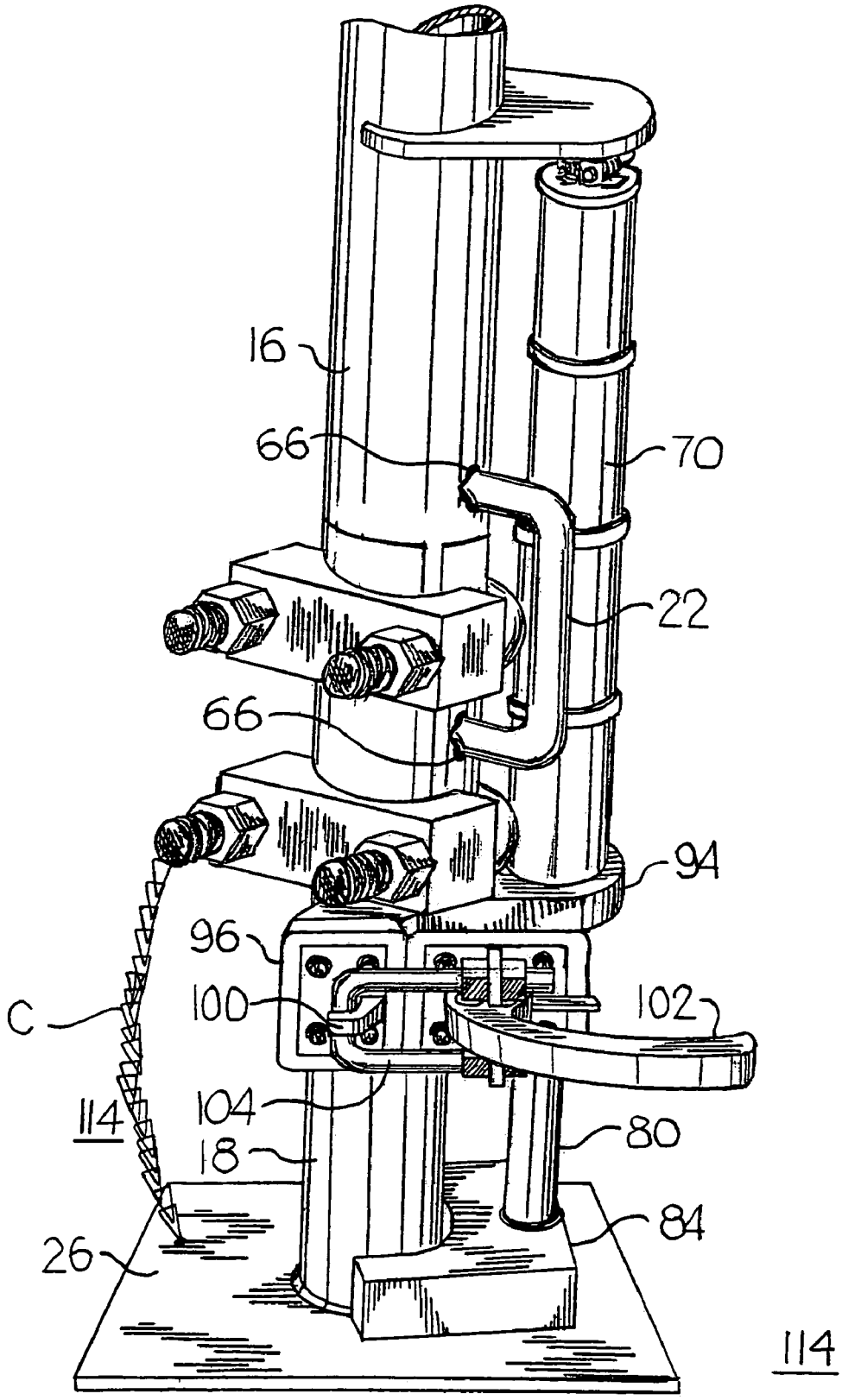
FIG. 7 is a side perspective view of the first embodiment yieldable prop and first embodiment jack assembly shown in FIG. 6.

As shown in FIG. 7, the yieldable prop 10 is then lifted into a perpendicular orientation with respect to the support surface 114. It is noted that the installation position of the yieldable prop 10 may be reversed, such that the first bearing plate 24 is positioned adjacent to the support surface 114.

In the orientation shown in FIG. 7, the second bearing plate 26 may be positioned adjacent to the support surface 114. Pressurized fluid, such as pneumatic or hydraulic fluid, is then allowed to enter the jack body 70. The pressurized fluid forces the piston arm 80 away from the jack body 70 and telescopes the first conduit 16 along the second conduit 18. A chain C having a predetermined length may be attached to the first conduit 16 and to the bearing plate 26 to indicate a desired extension length. It should be readily apparent to one skilled in the art that if the force acting on the plunger 78 (FIG. 4) is greater than the force required to crush or fragment the material which constitutes the mine roof or the mine floor, then the bearing plates 24, 26 will begin to be driven into the mine roof and the mine floor. To combat this effect, bearing plates having larger surface areas may be used. Also, to help combat non-symmetric loading, a dome-shaped bearing plate may also be used as discussed above.

Figure 8:
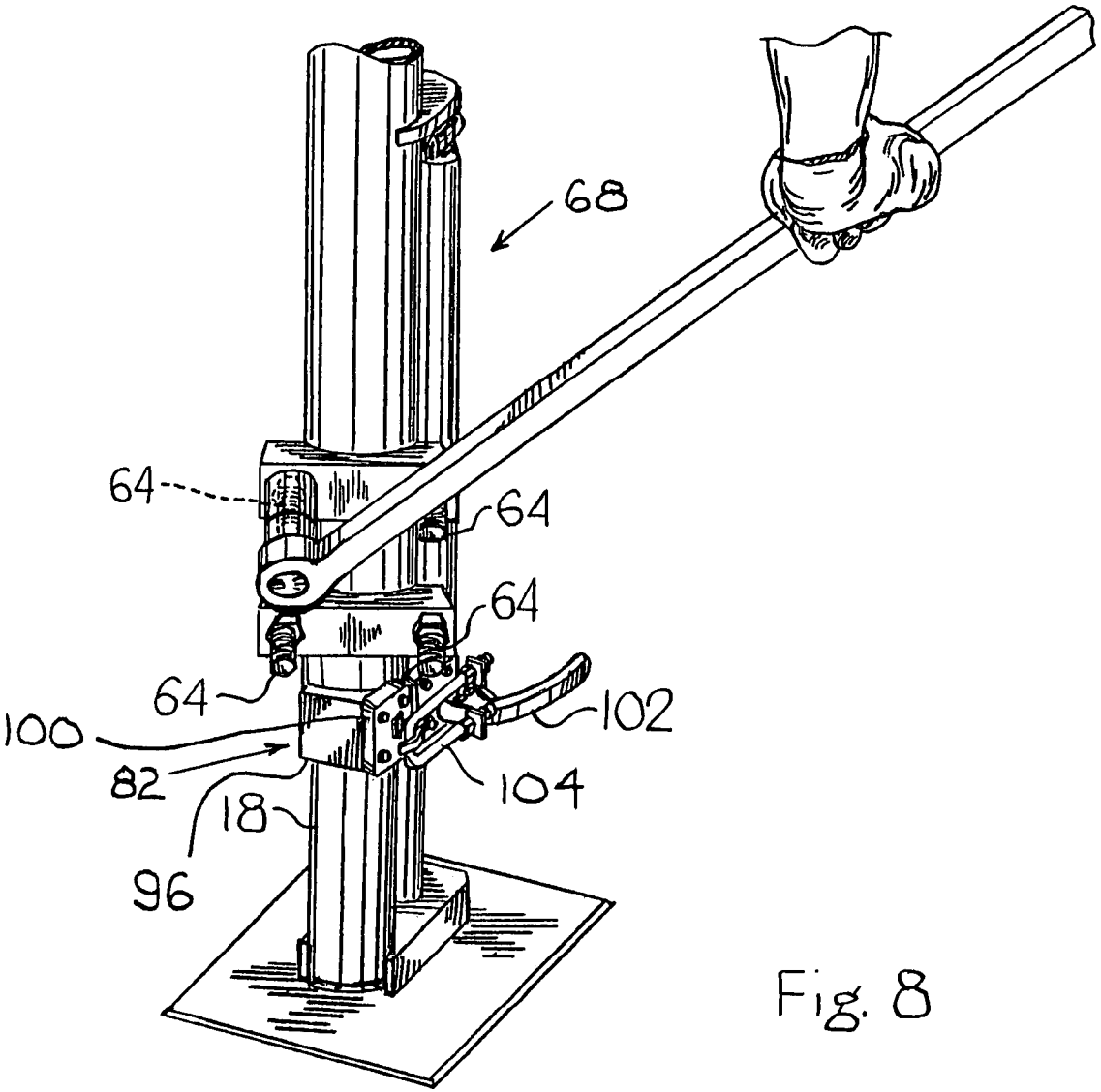
FIG. 8 is a side perspective view of the first embodiment yieldable prop and first embodiment jack assembly shown in FIG. 7.

As shown in FIG. 8, once the yieldable prop 10 has been telescoped to its desired length, the threaded nuts 64 are then torqued to approximately 300 foot pounds. The torquing of the threaded nuts 64 clamps the first and second split conduits 40, 46 (FIGS. 3 and 4) around the second conduit 18 and temporarily prevents the second conduit 18 from telescoping back inside the first conduit 16. At this point, the jack assembly 68 can be removed by moving the second handle 102 of the jack clamp 82 in the manner previously discussed above, such that the latch bar 104 can clear the hook 100 and the pivot arm 96 can be pivoted away from the clamp plate 94 (FIG. 5). Once tensioned, the yieldable prop 10 will retain its original tension until a compression or loading force acts on the yieldable prop 10.

Figure 9:
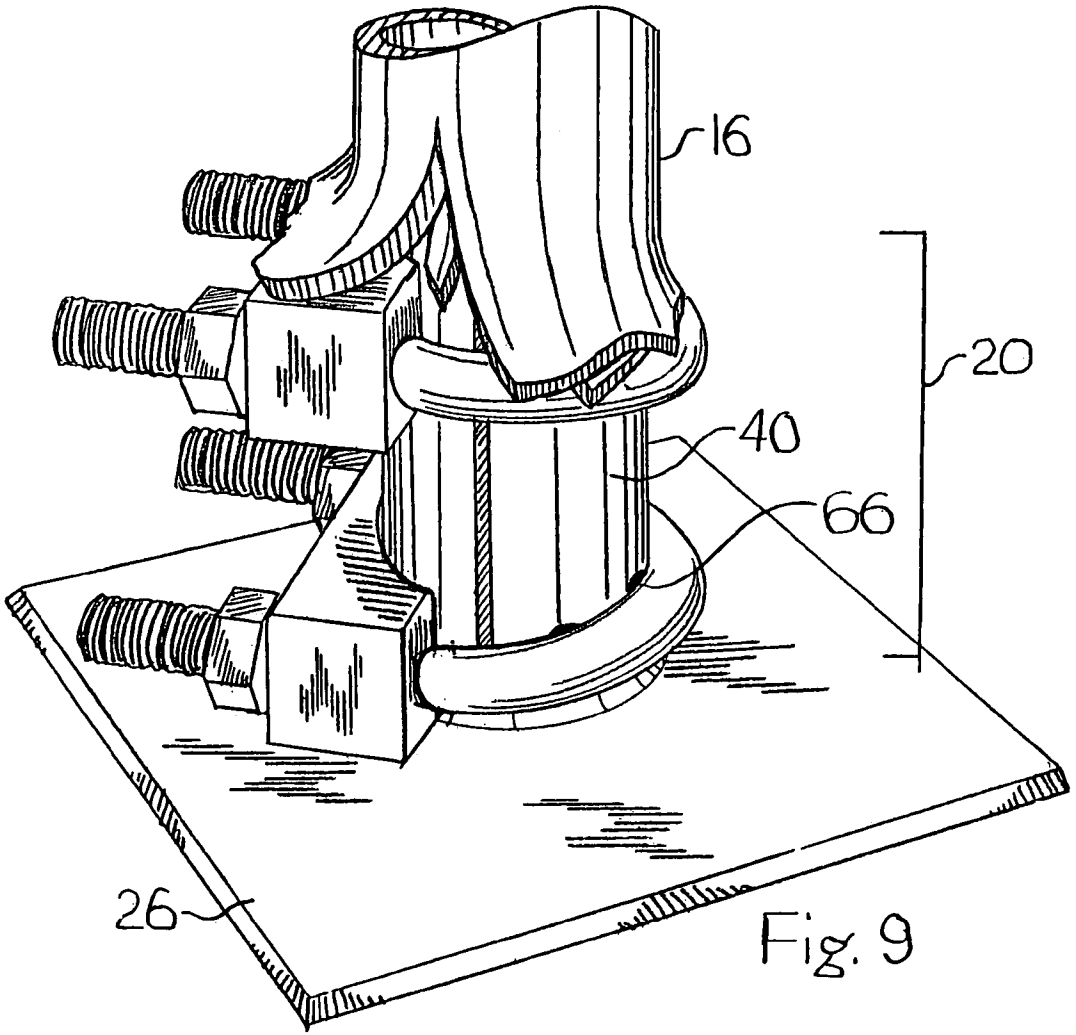
FIG. 9 is a side perspective view of one end of the first embodiment yieldable prop shown in FIG. 1, wherein the two conduits are telescoped together.

As shown in FIG. 9, as a compression load acts to compress the yieldable prop 10, such as a shifting mine tunnel roof, the clamp assembly 20 will slip and the second conduit 18 will gradually telescope back into the first conduit 16. Further compression of the yieldable prop 10 may drive the first conduit 16 into the first clamp assembly 20. At this point, further loading may begin to buckle the first and second conduits 16, 18 or split the first conduit 16. The buckling of the first and second conduits 16, 18 can be postponed by making the first conduit 16 and the second conduit 18 substantially overlap one another. During testing, it was observed that buckling may occur at a point along the first conduit 16, where there was not an overlap of the first conduit 16 and the second conduit 18. Also, increasing wall thickness of the first and second conduits 16, 18 may help to retard buckling of the yieldable prop 10.

Figure 10:
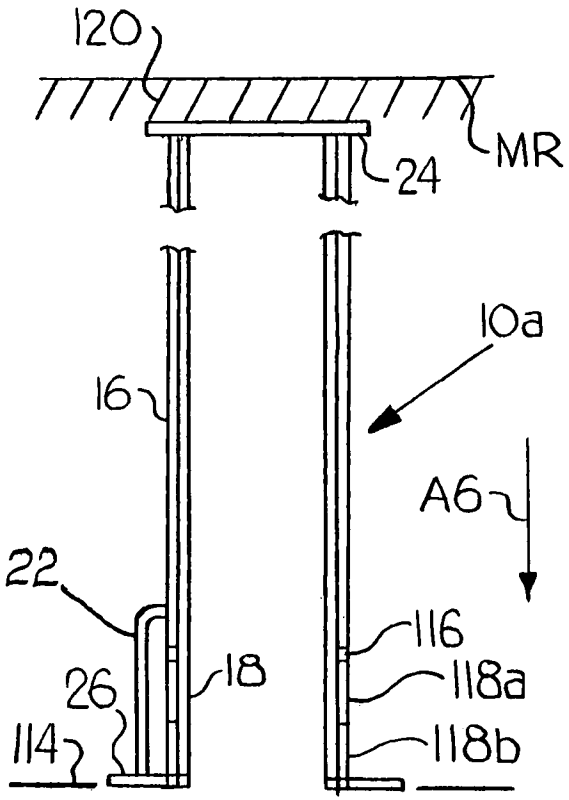
FIG. 10 is a partial cross-sectional view of a second embodiment yieldable prop and a second embodiment clamp assembly according to the present invention.

A second embodiment yieldable prop 10*a* is generally shown in FIG. 10. The second embodiment is similar to the first embodiment, with like reference numerals indicating like parts, and the previous discussion regarding bearing plates herein incorporated in its entirety. However, one difference between the first embodiment yieldable prop 10 and the second embodiment yieldable prop 10*a* is that the first clamp assembly 20 is removed and replaced with a generally cylindrically-shaped collar 116 and one or more collapsible inserts 118*a*, 118*b* positioned between the first conduit 16 and the second bearing plate 26 or, conversely, between the second conduit 18 and first bearing plate 24 if the prop 10*a* is reversed. The collar 116 may have the same outer diameter as the inserts 118*a*, 118*b* or have an outer diameter which is greater than the outer diameter of the inserts 118*a*, 118*b*.

The second embodiment yieldable prop 10*a* is designed to be adjustable in the A6 direction, as shown in FIG. 10. The yieldable prop 10*a* is preferably made at a predetermined overall length which is dependent upon the distance between a mine roof and a mine floor. For the purpose of example only, a six foot high mine passageway may require a five foot, eight inch prop 10*a*. To help keep the various pieces together during shipping, a handle 22 may be added to the first conduit 16 and a bearing plate 26. As noted above with respect to the first embodiment yieldable prop 10, the bearing plates 24, 26 may be removable so that the handle 22 may also be connected to the insert 118*b*.

Installation of the second embodiment yieldable prop 10*a* is straightforward. The prop 10*a* is erected so that the first and second conduits 16, 18 are substantially perpendicular to a mine roof MR and support surface 114, or any other two opposed surfaces. Because the prop 10*a* is made slightly shorter than the distance between the mine roof MR and support surface 114, compressible material 120, such as wood or other suitable material, is forced between the first bearing plate 24 or 26 and the mine roof MR so that the prop 10*a* is wedged snuggly between the mine roof MR and the support surface 114.

If the mine roof MR shifts and applies a compression load in the A6 direction, the force of the compression load is generally transferred to the compressible material 120, the bearing plates 24, 26, the first conduit 16, the second conduit 18, and the collar 116. In turn, the collar 116 exerts a force against the insert or inserts 118*a*, 118*b*.

The collar 116 is preferably made from a durable material, such as steel. The insert or inserts 118*a*, 118*b* are preferably each made from one gauge of steel having a predetermined yield value or different gauges of steel each having individual predetermined yield values. Therefore, the inserts 118*a*, 118*b* will resist compression until the compression load exceeds the structural endurance of the insert 118*a*, 118*b*. As shown in FIG. 10, inserts 118*a*, 118*b* can be made from the same gauge steel and will, therefore, yield in a similar manner. Inserts 118*a*, 118*b* may also be integrally formed. If staged yielding is desired, insert 118*a* can be made from a thinner gauge material than insert 118*b*. In this configuration, insert 118*a* will compress before insert 118*b*. In compression tests, inserts made from A513 tubing and having a thickness of approximately 0.120 inch yielded when subjected to a compression force of approximately fifty tons. It has been found that the inserts 118*a*, 118*b* tend to compress rather than split, and generally each define an accordion-shaped, cross-sectional profile after being compressed. The accordion-like compression of the inserts 118*a*, 118*b* results in a cyclical resistance yield pattern. The cyclical pattern is believed to be the result of the insert contacting the conduit, the insert yielding, and insert contacting the conduit again, and process repeating.

Figure 11:
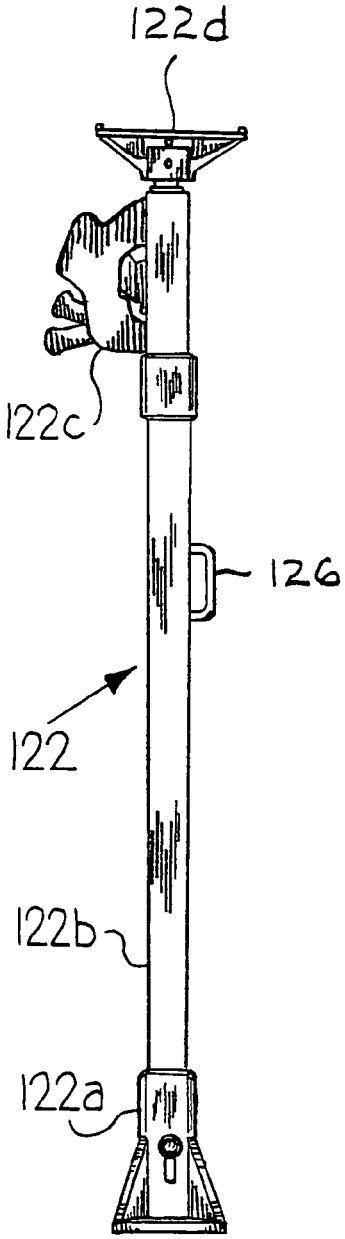
FIG. 11 is a side view of a commercially available jack assembly.
Figure 12:
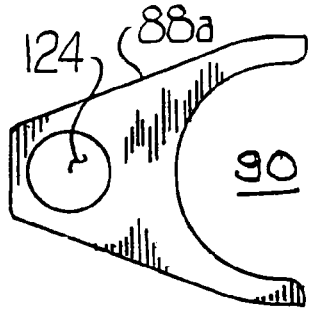
FIG. 12 is a plan view of a second embodiment guide.
Figure 13:
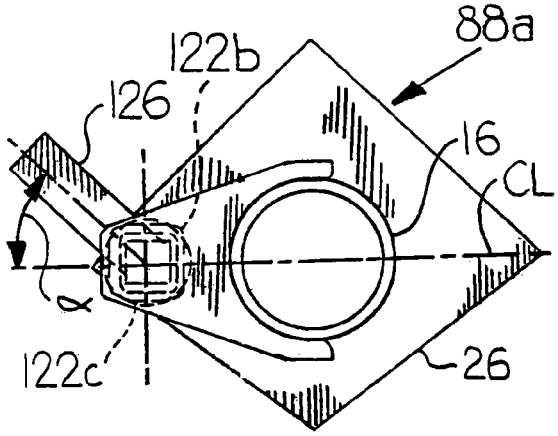
FIG. 13 is a partial top view of the second embodiment jack assembly shown in FIG. 11 fitted with the second embodiment guide shown in FIG. 12 and an offset handle.
Figure 14:
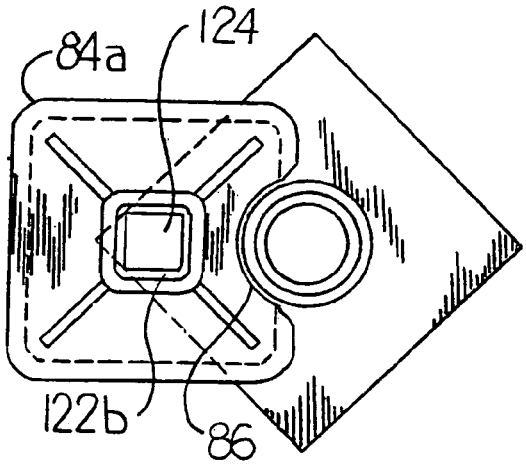
FIG. 14 is a partial top view of a second embodiment base.

A commercially available jack assembly 122 is shown in FIG. 11 and is modified in FIGS. 12-14. The jack assembly 122 is preferably a manual jack-type support, such as the Model A9225 commercially available from SIMPLEX, Broadview, Ill. and herein incorporated by reference in its entirety. The jack assembly 122 generally includes a stock base 122*a*, a dowel 122*b* connected to the stock base 122*a*, a manual ratchet jack 122*c* attached to the dowel 122*b*, and a stock head 122*d* connected to the manual ratchet jack 122*c*. The jack assembly 122 is used primarily with the first embodiment yieldable prop 10, subject to the modifications shown generally in FIGS. 12-14.

FIG. 12 shows a second guide 88*a* defining a post receiving orifice 124 and the second partial orifice 90. As shown in FIG.

13, the second guide 88*a* replaces the stock head 122*d* which is included with the Model A9225 support, with the partial orifice 90 receiving the first conduit 16. A handle 126 is also offset at an angle α with respect to centerline CL, instead of being substantially aligned with centerline CL. Similarly, as shown in FIG. 14, the second embodiment base 84*a* also defines a post receiving orifice 124 and a first partial orifice 86.

The second embodiment jack assembly, which is herein defined as the combination of the modified jack assembly 122, the second guide 88*a*, and the second embodiment base 84*a*, is raised and lowered by the manual ratchet jack 122*c*. The operation of the second embodiment jack assembly is used for substantially the same purpose as the first embodiment jack assembly discussed above, namely, the expanding of the prop 10. A hook and latch strap may be used to temporarily secure the second embodiment jack assembly to the prop 10.

Figure 15:
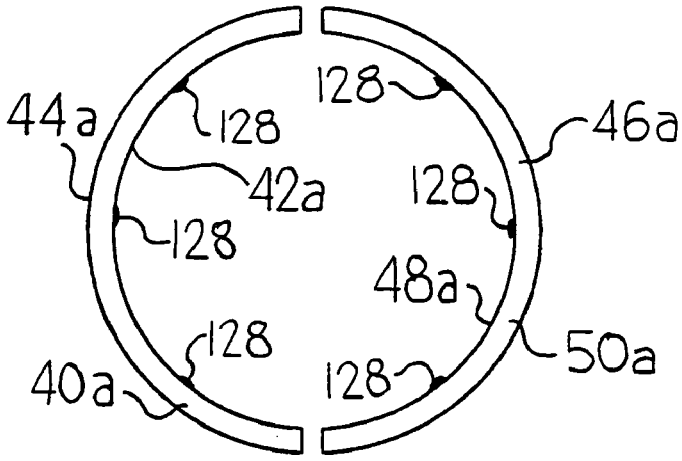
FIG. 15 is a plan view of a third embodiment clamp assembly.

As shown in FIG. 15, a first split conduit 40*a* defining a first split inner surface 42*a* and a first split outer surface 44*a*, and a second split 46*a* conduit defining a second split inner surface 48*a* and a second split outer surface 50*a* can also be used with the first and second split inner surfaces 42*a*, 48*a* having friction members 128, such as tack welds, attached thereto. In this latter embodiment, it has been found that only one U-shaped bolt (discussed below) is required and the friction members 128 gouge into the first conduit 16 to help resist compression.

Figure 16:
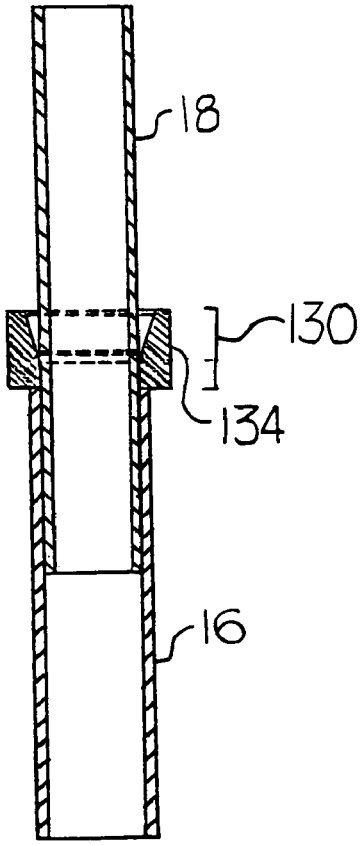
FIG. 16 is cross-sectional side view of a third embodiment yieldable prop according to the present invention.
Figure 16A:
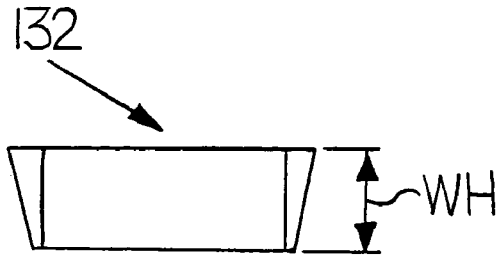
FIG. 16*a* is a cross-sectional side view of a wedge shown in FIG. 16.
Figure 16B:
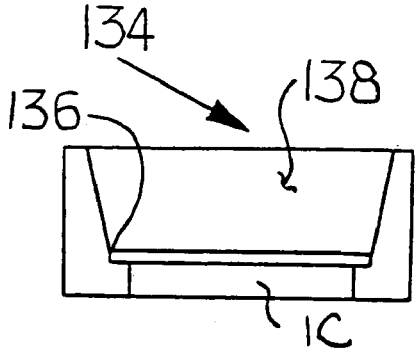
FIG. 16*b* is a cross-sectional side view of a housing shown in FIG. 16.

As shown in FIGS. 16, 16*a*, and 16*b*, a wedge and housing combination 130 can also be used to provide predetermined loading. As shown in greater detail in FIG. 16*a*, the wedge 132 is preferably a hollow cylindrical member having a height WH and a tapered outer diameter tapering to a base level outside diameter. The wedge 132 is attached to the external surface of the second conduit 18 by hardened threads, friction, clamping, welding, or other suitable method. A housing 134, shown in detail in FIG. 16*b*, has a substantially static outer diameter, but includes an inner diameter that tapers to an intermediate internal diameter. A lip 136 is defined at the base level inner diameter of the housing 134, wherein the lip 136 and tapered inner diameter of the housing 134 define a race 138 that receives the wedge 132. Adjacent to the race 138, the housing 134 defines an internal cavity IC that receives second conduit 18. The housing 134 is positioned immediately adjacent to one end of the first conduit 16 and, when adjusted to the desired height, prevents the second conduit 18 from substantially further entering the first conduit 16.

Referring again to FIG. 16, when the wedge 132 and housing 134 are employed, the housing 134 resists the outward force of the wedge 132 as the load acting on the second conduit 18 moves the second conduit into the first conduit 16. Movement of the wedge 132 into the housing 134 resists further movement of the second conduit 18 with respect to the first conduit 16 for a given load.

Figure 17A:
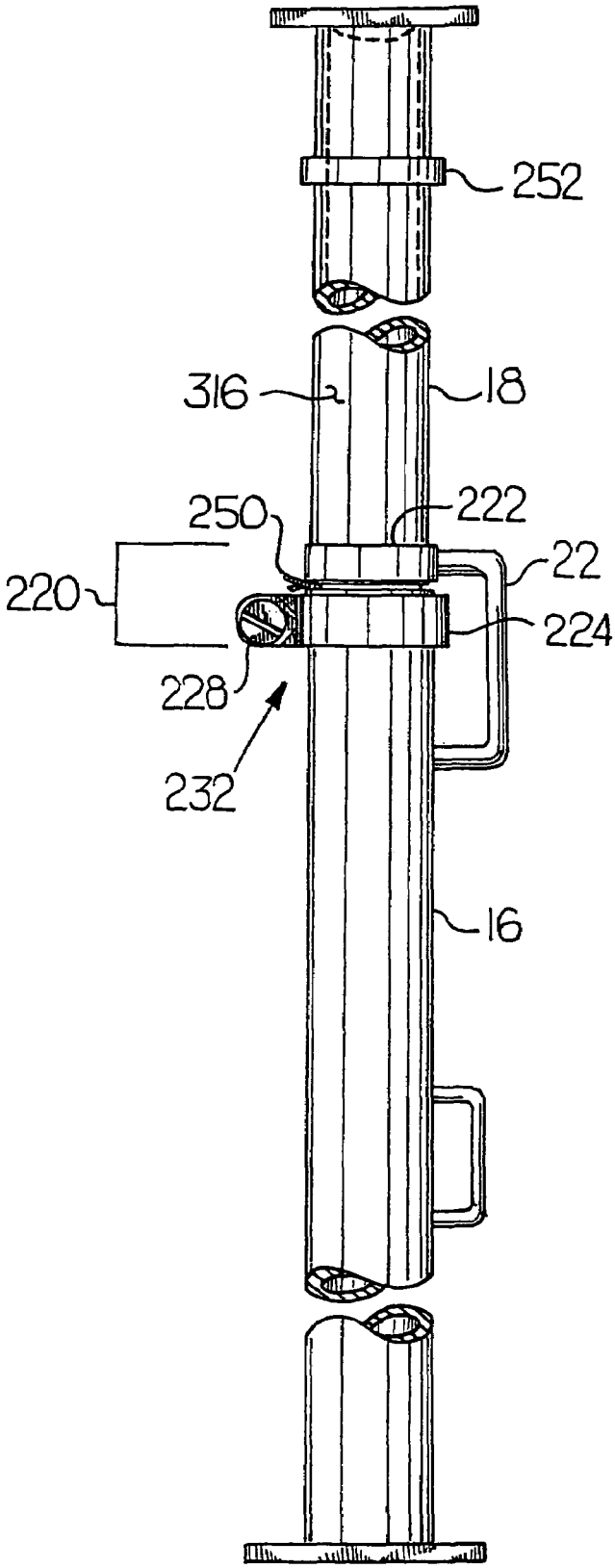
FIG. 17*a* is a side view of another embodiment yieldable prop according to the present invention.

Another embodiment yieldable prop 10*b* is generally shown in FIG. 17*a*. This embodiment is similar to the first embodiment, with like reference numerals indicating like parts, and the previous discussion regarding bearing plates herein incorporated in its entirety.

In this embodiment, first clamp assembly 20 is replaced with a second clamp assembly 220. The second clamp assembly 220 is positioned adjacent to the second outer surface 36 of the second conduit 18. A ring 222 is slidably positioned around the second conduit 18. The handle 22 is attached to the first hollow conduit 16 and the ring 222 to help prevent the second clamp assembly 220 and the prop 10 from becoming disassembled during shipping or handling.

The second clamp assembly 220 includes a housing 224, a wedge 226, a bolt 228, and a nut 230. The housing 224 is positioned on top of and/or around the first conduit 16 adjacent to one end 232 of the first conduit 16. The wedge 226 engages or is attached to the second outer surface 316 of the second conduit 18. The wedge 226 is configured to engage the housing 224 to prevent the second conduit 18 from further entering the first conduit 16, as discussed above.

The wedge 226 may be configured as the wedge 132 discussed above. Alternatively, and preferably, the wedge 226 is a two-piece construction including a first wedge member 234 and a second wedge member 236. The first wedge member 234 and the second wedge member 236 form a generally hollow, cylindrical member having a tapered outer diameter. In this manner, the wedge 132 acts as a compressing member. More particularly, as the first and second wedge members 234 and 236 move into the housing 224, inner surface 240 of the housing (FIG. 19*a*) decreases the distance between adjacent ends of the wedge members 234 and 236 moving the inner surfaces of the wedge members 234 and 236 into engagement with the outer surface of the second conduit 18. The first wedge member 234 and the second wedge member 236 are attached to the outer surface 36 of the second conduit 18 by clamping, welding, friction (from the housing 224), or other suitable method. The wedge 226 preferably includes a threaded inner surface 238. The threaded form 238 improves the grip of the wedge 226 on the second conduit 18.

Figure 19B:
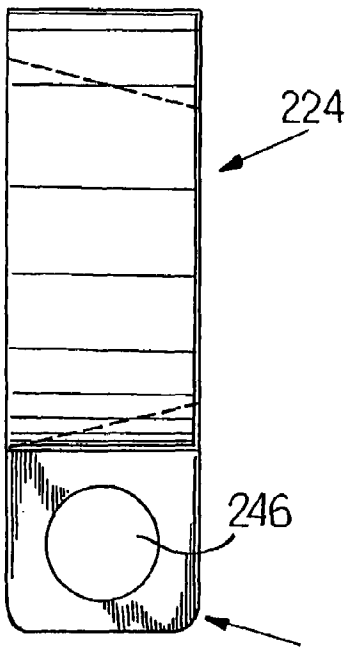
FIG. 19*b* is a cross-sectional side view of a housing shown in FIG. 19*a;*
Figure 19A:
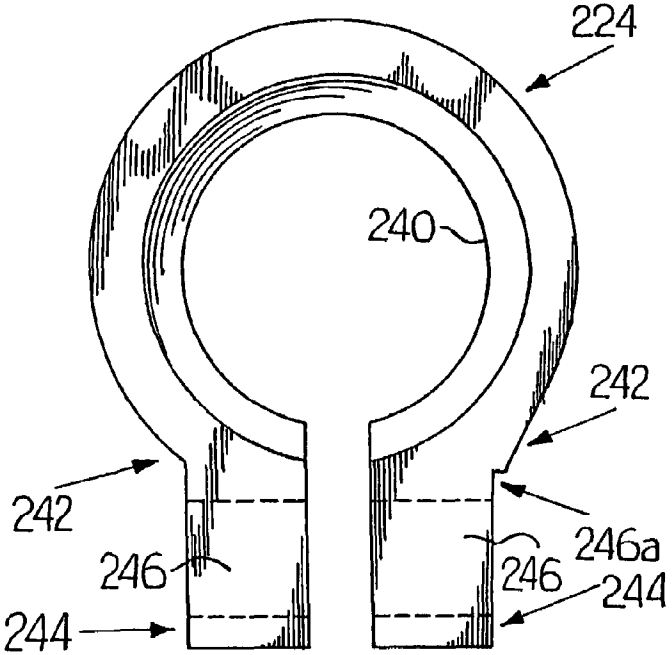
FIG. 19*a* is a cross-sectional top view of a housing shown in FIG. 17*a;*
Figure 19C:
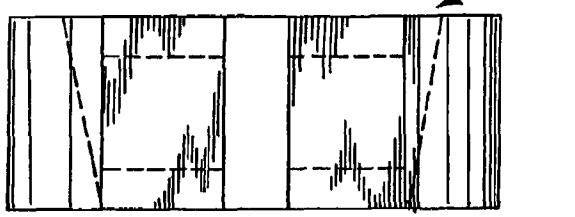
FIG. 19*c* is a cross-sectional end view of a housing shown in FIG. 19*a;*
Figure 18A:
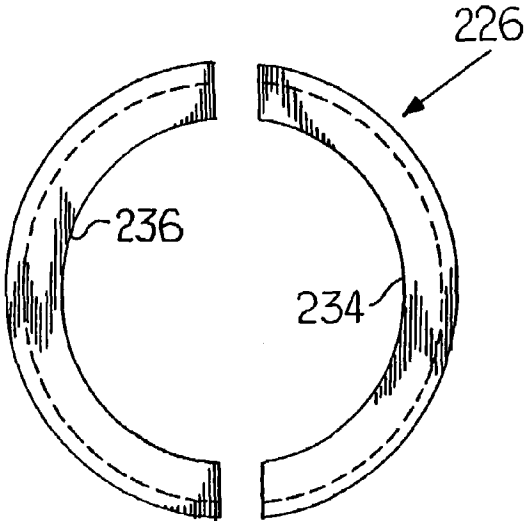
FIG. 18*a* is a cross-sectional top view of a wedge shown in FIG. 17*a;*
Figure 18B:
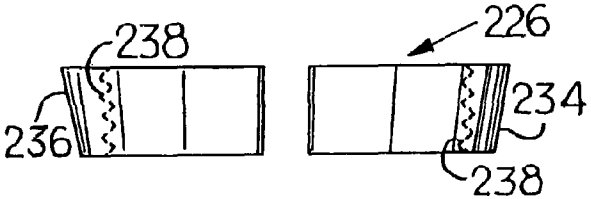
FIG. 18*b* is a cross-sectional side view of a wedge shown in FIG. 18*a;*

With reference to FIGS. 18*a*, 18*b*, and 19*a*, the housing 224 has an inner surface 240 compatible with the shape of outer surface of the wedge 226, e.g., surfaces 234 and 236. Because cylindrically-shaped conduits are typically used (as shown in the drawings), the housing 224 is preferably generally C-shaped with opposed ends 242. A pair of parallel legs 244 extend from the opposed ends 242 of the housing 224. Each leg 244 includes a bolt opening 246 configured to receive the bolt 228 therethrough. The nut 230 is received on the bolt 228 and may be torqued to a calibrated load. The bolt openings 246 may include recesses 246*a* for the seating of a bolt head 228*a* and/or the nuts 230. The calibrated load is determined by a calibration curve plotting nut torque to load (residual or maintained). In the practice of the invention, it is preferred that the second clamp assembly 220 will maintain 100% of the applied load to the housing 224 and wedge 226.

Because the second clamp assembly 220 is a combination of pieces, the second clamp assembly 220 can be vibrated loose during shipping. To solve this problem, a ring tie 250 is removably positioned between the ring 222 and the second clamp assembly 220 to hold the wedge 226 in an engaged relationship with the housing 224.

The prop 10 may be set by hand. Alternatively, to install the prop 10, a jack assembly 68, 122 as discussed hereinabove or another conventional jack assembly may be used. A jack interface 252 is connected to either the first conduit 16 or the second conduit 18. The jack interface 252 may be a ring configured to interact with the jack assembly.

Figure 20:
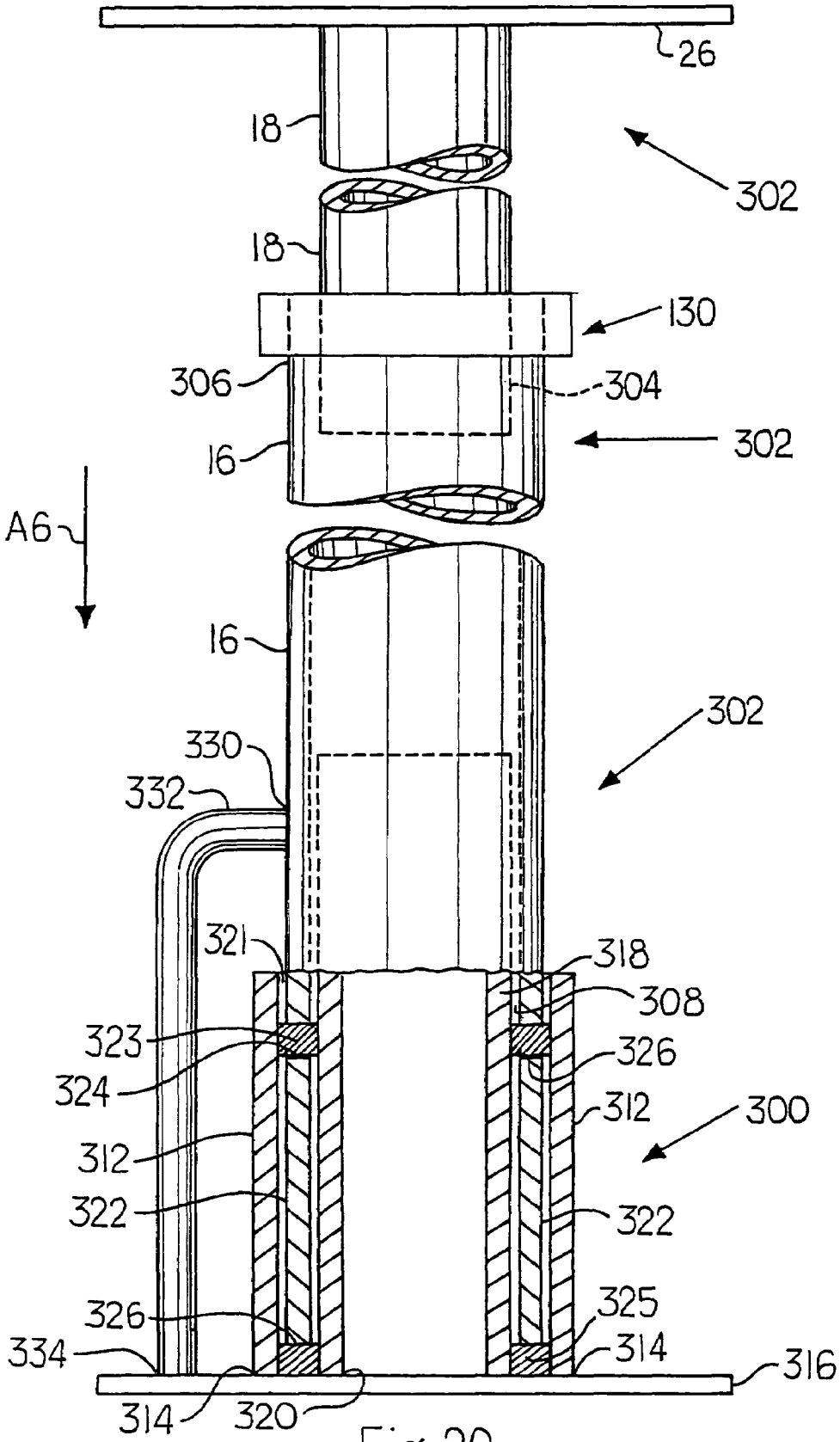
FIG. 20 is sectional side view, in cross section, of a yieldable prop incorporating features of the invention having a yield section at one end of the prop.

As can be appreciated, the invention is not limited to the non-limiting embodiments of the invention discussed herein and modifications can be made without deviating from the scope of the invention, and the invention contemplates combining features of the non-limiting embodiments of the invention discussed herein. For example and not limiting to the invention, FIG. 10 discussed above shows yieldable prop 10*a* having a yield section including the collar 116 and the inserts 118*a* and 118*b*. With reference to FIG. 20 there is shown another non-limiting embodiment of a yield section or yield arrangement identified by the number 300. The yield section 300 and the yield section of FIG. 10 can be used with the clamp assembly 20 shown in FIGS. 1-3, the wedge and housing combination 130 shown in FIGS. 16, 16*a*, and 16*b*, and the clamp assembly 220 shown in FIGS. 17*a*, 17*b*, 18*a*, 18*b*, and 19*a*-19*c*, and discussed above.

With continued reference to FIG. 20, the yield section 300 is part of yieldable prop 302, which includes the second conduit 18 having the bearing plate 26 at one end and end portion 304 of the second conduit 18 slidably mounted in end portion 306 of the first conduit 16. The end portion 308 of the first conduit 16 mounts the yield section 300 in a manner discussed below. The first and second conduits 16 and 18 are set in a relative position to one another in any convenient manner, e.g., but not limiting the invention thereto, using the jack assembly 68 discussed above and shown in FIGS. 1-8 or the jack assembly 122 discussed above and shown in FIGS. 11-14, and are secured in the relative position by the wedge and housing combination 130 shown in FIGS. 16, 16*a*, and 16*b*. As can be appreciated, the invention is not limited by the arrangement to secure the first and second conduits in position relative to one another and any clamping arrangement of the type known in the art can be used, e.g., but not limiting the invention thereto, the clamp assembly 20 shown in FIGS. 1-3, and the clamp assembly 220 shown in FIGS. 17*a*, 17*b*, 18*a*, 18*b*, and 19*a*-19*c*, and discussed above.

The yield section 300 includes a shroud 312 having end 314 securely mounted to bearing plate 316, and an inner pipe 318 having end 320 securely mounted to the plate 316 with the center axis of the shroud and the inner pipe concentric with one another to provide a space 321 therebetween for receiving an insert 322 capable of withstanding a predetermined compressive force before collapsing as discussed below and, optionally, an upper follower ring 323 positioned between end portion 308 of the first conduit 16 and end, e.g., upper end 324, of the insert 322, and a lower follower ring 325 between the bearing plate 316 and the lower end 326 of the insert 322.

As can be appreciated, the inner pipe 318 can be a hollow pipe or a solid rod. Further, the end 314 of the shroud 312 and the end 320 of the inner pipe 318 can be secured to the plate 316 in any usual manner, e.g., by welding. In this discussion, the first conduit 16, the second conduit 18, the shroud 312, the insert 322, the follower rings 323 and 325, and the inner pipe 318 have a circular cross section; however, as can be appreciated, the invention is not limited thereto and the conduits, shroud, insert, follower rings, and inner pipe can have any cross-sectional shape as long as the conduits, shroud, insert, follower rings, and inner pipe can slide relative to one another as required and discussed herein. For example but not limiting to the invention, the conduits can have an elliptical, triangular, square, rectangular, trapezoidal, or any other straight line or curved line polygon cross section.

The insert 322 can be a single piece, a plurality of vertical pieces as mounted in the space 321, or of a plurality of conduit segments piled one on top of the other in the space 321, e.g., similar to the inserts 118*a* and 118*b* shown in FIG. 10. The sections or plurality of conduit segments can be made of material having the same or different compressive strength, e.g., for stage yielding as previously discussed.

In the practice of the invention, the lower follower ring 325, the insert 322, and the upper follower ring 323 are placed in the space 321 between the inner surface of the shroud 312 and the outer surface of the inner pipe 318, and the end portion 308 of the first conduit 16 moved over the inner pipe into the space 321 into contact with the upper follower ring 323. Preferably, the inner pipe has a length or height greater than the combined length or height of the follower rings 323, 325 and the insert 322, and the length or height of the shroud 312 has a length or height greater than the combined length or height of the follower rings 323, 325 and the insert to guide the end portion 308 of the first conduit 16 into the space 321 and minimize sideward movement of the first conduit 16, e.g., provide vertical and lateral stability to the first conduit 16. As can be appreciated and not limiting to the invention, the length of the inner pipe 318 extends into the first conduit 16 a length to provide the vertical and lateral stability while maintaining a spaced distance from the end 304 of the second conduit 18 to provide for the compression of the insert 322 in a manner discussed below without the end 304 of the second conduit 18 contacting the inner pipe which can resist the downward motion of the first conduit 16 to compress the yield section.

In those instances when the yield section 300 is mounted to the end 308 of the first conduit 16 at an assembling area (not shown), the yield section is maintained on the end of the conduit when moving the yieldable prop to its work location by securing, e.g., but not limiting to the invention, by tack welding, one end 330 of a handle 332, e.g., 0.5 inch rod to the outer surface of the first conduit 16, and the other end 334 of the handle 332 to the bearing plate 316 as shown in FIG. 20.

The use of the upper follower ring 323 is not limited to the invention and is recommended to provide for the application of a uniformly distributed compression force by the end portion 308 of the first conduit 16 to the upper surface of the insert 322. For example, but not limiting to the invention, in the instances when the wall thickness of the first conduit 16 and the insert 322 are different, and/or the outer diameter of the first conduit 16 and the outer diameter of the insert are different and/or the space 321 is sufficiently large to have misalignment of the end of the first conduit 16 and the end of the insert 322, the use of the upper follower ring 323 between the end of the first conduit 16 and the end of the insert 322 is recommended to provide for the application of a uniformly distributed compression force by the end 308 of the first conduit 16 to the upper surface of the insert 322. The distance between the outer surface of the upper follower ring 323 and the inner surface of the shroud 312, and the inner surface of the upper follower ring 323 and the outer surface of the inner pipe 318 should be maintained at a minimum to reduce sideward motion of the follower ring in the space while reducing friction between the surfaces of the follower ring and adjacent surface of the shroud 312 and the inner pipe 318. In a non-limiting embodiment of the invention and not limiting to the invention, an upper follower ring 323 having an outer surface spaced 0.025 inch from the inner surface of the shroud 312, and the inner surface of the follower ring spaced 0.0125 inch from the outer surface of the inner tube 318 was used.

The use of the lower follower ring 325 is not limiting to the invention and is recommended when there is a probability that the weld mounting the end of the shroud to the bearing plate can be fractured and the lower portion of the insert can move outwardly by the compression of the insert. As can be appreciated, a solid bead of welding connecting the end of the shroud to the bearing plate is expected to be sufficient to withstand the force of the insert as it is compressed. Further, the use of a lower follower ring between the lower end of the insert and the bearing plate should provide for the compressive force of the insert to be applied to the shroud at a position spaced from the weld. The thickness of the lower ring is not limiting to the invention. Lower follower rings having a thickness of 0.50 inches have been used.

The first and second conduits 16 and 18, and the follower rings 323 and 325 should be made of a material and have a thickness to withstand higher compression forces than the insert. In this manner, the insert will collapse under a given load before the conduits and follower rings collapse. Further, the wall thickness of the shroud and of the inner pipe when hollow should be sufficient to prevent bulging of the wall of the shroud or inner pipe. For compression loads of 50 to 60 tons, shrouds and inner pipes made of schedule 10 conduits or greater can be used in the practice of the invention. Preferably, but not limiting to the invention, schedule 40 conduits are preferred.

In general, when a load is applied of sufficient force to totally compress the insert, the parameters of interest regarding % reduction in the length or height of the insert is a function of the distance between the inner wall of the shroud, and the outer surface of the inner pipe and the thickness of the insert. As the distance between the inner wall of the shroud and the outer surface of the inner pipe increase while the remaining parameter remains constant, the length of the totally compressed insert is greater than if the distance was decreased, and as the thickness of the insert decreases and the remaining parameter remains constant, the length of the totally compressed insert is greater than if the thickness of the insert is increased. Although not limiting to the invention, in the practice of the invention, it is preferred to size the space 321 and the wall thickness of the insert to provide for the insert to reduce in length by 60% to 70%. As can be appreciated, as the first conduit 16 moves into the space 321, depending on the length of the handle 332, the end 330 of the handle 332 can contact the shroud 312. Because the end 330 of the handle 332 is tack welded, the shroud 312 will fracture the tack weld as the first conduct 16 compresses the insert 322 and moves into the space 321.

Figure 17B:
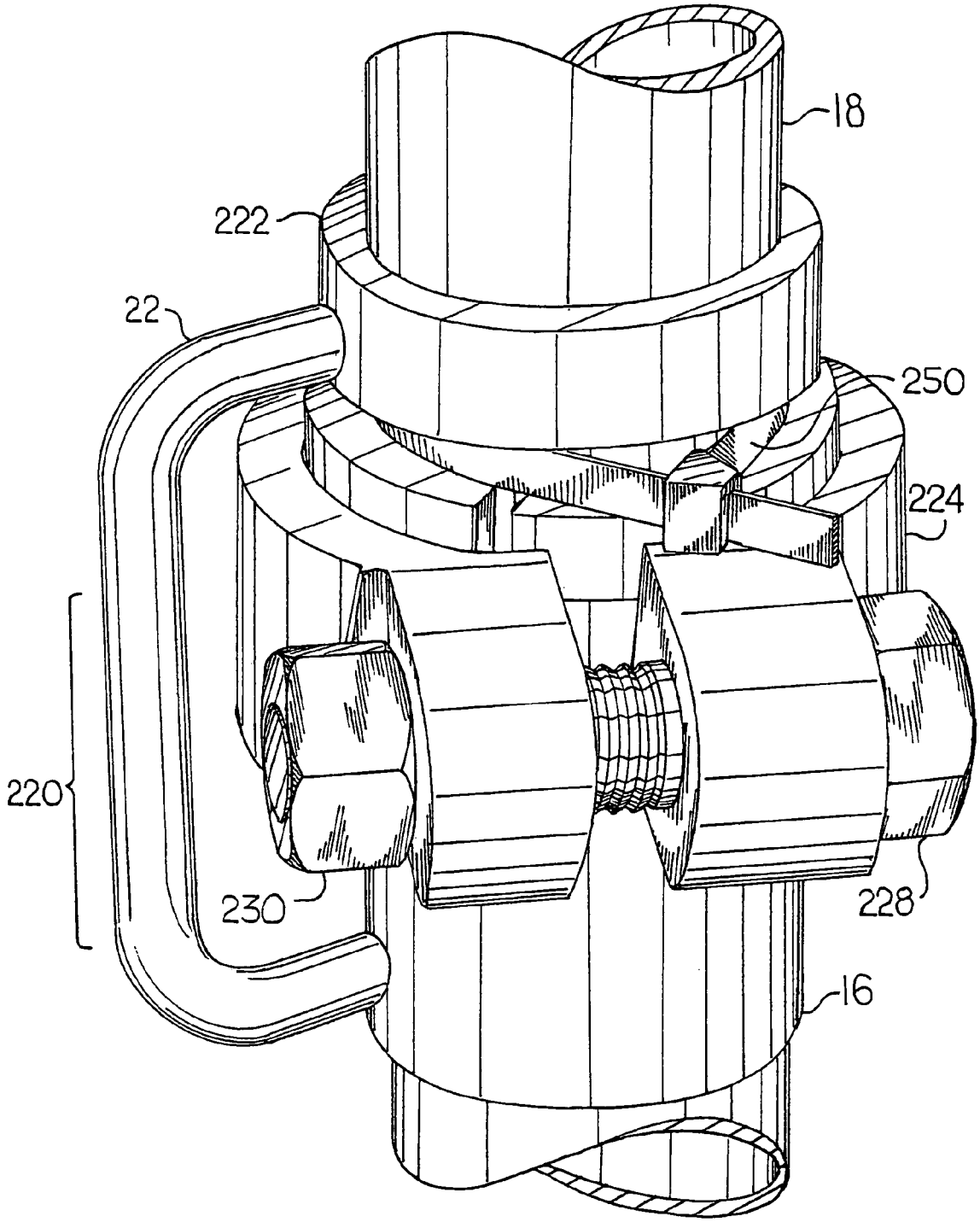
FIG. 17*b* is a partial perspective view of the yieldable prop shown in FIG. 17*a;*

In the practice of the invention, but not limiting thereto, the yieldable prop 302 is positioned in the upright position with the bearing plate 316 on the mine floor. With reference to FIG. 17*b*, the ring tie 250 is removed from the second conduit 18, and the nut 230 and bolt 228 loosened to reduce the pressure of the housing 224 on the wedge 226 (FIG. 18*a*). The second conduit 18 is moved upward out of the conduit moving the wedge sections out of the housing 224 into contact with the ring 222 (see FIG. 17*a*) as the bearing plate 26 moves toward the ceiling, e.g., against the ceiling. The second conduit 18 is released and moves downward engaging the wedge and moving the wedge into the housing. Thereafter, the bolt 228 and nut 230 are tightened to tighten the housing around the wedge 226 to secure the first and second conduits in position relative to one another. Compressible material, e.g., wedge-shaped pieces of wood, are forced between the bearing plate 26 and the mine ceiling.

In the instance when the mine roof shifts and applies a compression load in the A6 direction, the force of the compression load seats the second conduit 18 and the wedge 226 in the housing 224, and the wedge and housing combination prevents further displacement of the second conduit into the first conduit. As the compression load on the bearing plate increases, the compression load applied to the first and second conduit is transferred to the insert 322. As can be appreciated by those skilled in the art, when the force required to compress the insert is greater than the compressive force acting on the bearing plates, the bearing plates will begin to be driven into the mine roof and the mine floor. Therefore, the compressive force required to compress the insert should consider the condition of the surface on which the yieldable prop is to be used.

A yieldable prop incorporating features of the invention was constructed by the Jennmar Corporation and tested by the National Institute of Occupational Safety and Health at its safety structures testing laboratory in Bruceton, Pa. The yieldable prop was tested at a length of about 6 feet. The first conduit 16 was a 3-inch schedule 80 pipe, and the second conduit 18 was a 2.5-inch schedule 80 pipe. The inner pipe 318 of the yield section 300 was a 2.5 schedule 80 pipe having a height of 19 inches, the shroud 312 was 3.5 schedule 40 pipe having a length of 11 inches tack welded to the bearing plate 316, the insert 322 had an outside diameter of 3.25 inches, a wall thickness of 0.095 inch and a height of 11 inches, and the lower follower ring 325 each was a 3-inch schedule 80 pipe having a height of 0.5 inch. An upper follower ring 323 was not used.

Figure 21:
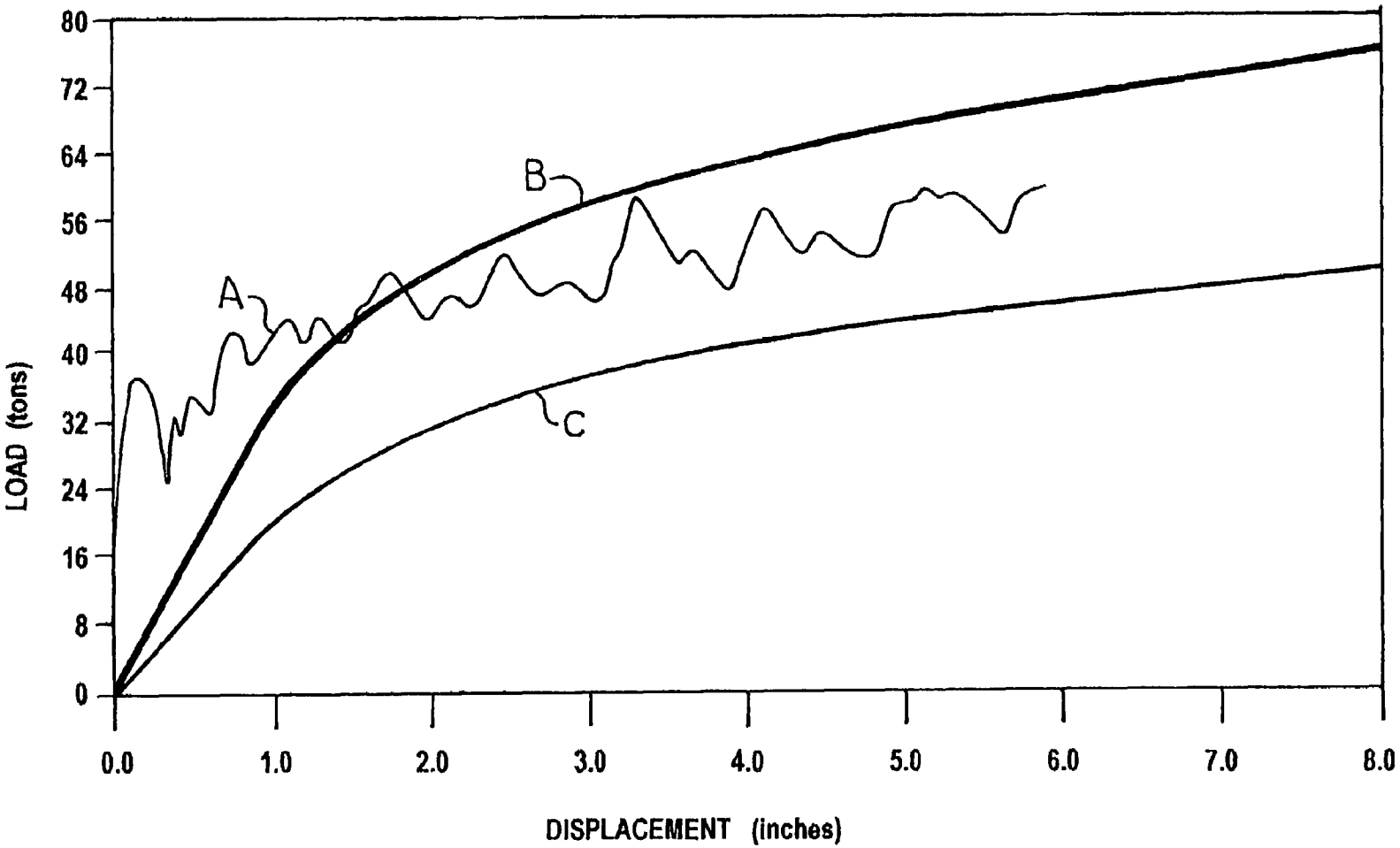
FIG. 21 is a graph showing the compression load in tons and displacement, i.e., reduction, in length in inches for the prop of the invention and two wooden cribs having different contact surface areas.

With reference to FIG. 21 there is shown Curves A-C for displacement in inches for an applied load in tons for the insert of the yield tube of the invention (Curve A), for a 4 point, 6-inch surface contact crib (Curve B) and for a 4 point 5-inch contact surface crib (Curve C). Each of the cribs was made of 5 inches by 6 inches by 30 inches pieces of hardwood. Two spaced pieces of hardwood made up each layer and spaced pieces of adjacent layers were rotated 90° to provide a stack having solid corners and sides having a space between adjacent layers. The 6 inches surface contact had the 6 inches surfaces in contact with one another, and the 5 inches had the 5 inches surfaces in surface contact with one another.

With continued reference to FIG. 21, Curves B and C have a generally smooth shaped curve with increased displacement as the load increases showing a continuous displacement as the load increases. The yield insert of the invention (Curve A) had minimal displacement for a load of less than 38 tons. It is believed that the insert did not compress for a load less than 38 tons and the small displacement was the result of the wedge and the first conduit being seated in the housing, and the follower rings and insert being seated in the space 321. As the load increased, the insert 322 resisted compression until the compression load exceeds the structural endurance of the insert at which time a portion of the insert collapses or compresses. It has been found that the insert tends to collapse or compress rather than split and generally define an accordion shape in side view confined by the outer wall of the inner pipe and the inner wall of the shroud. The accordion-like compression of the insert results in a cyclical resistance yield pattern shown in FIG. 21. Increasing the load resistance of the insert raised the Curve A, i.e., more load with less displacement. Further, as the friction between the surface of the insert and the surface of the space increases as a result of the insert compressing and engaging the walls making up the space, the load required to further compress the insert increases as shown by the upward trend of the Curve A.

Figure 22:
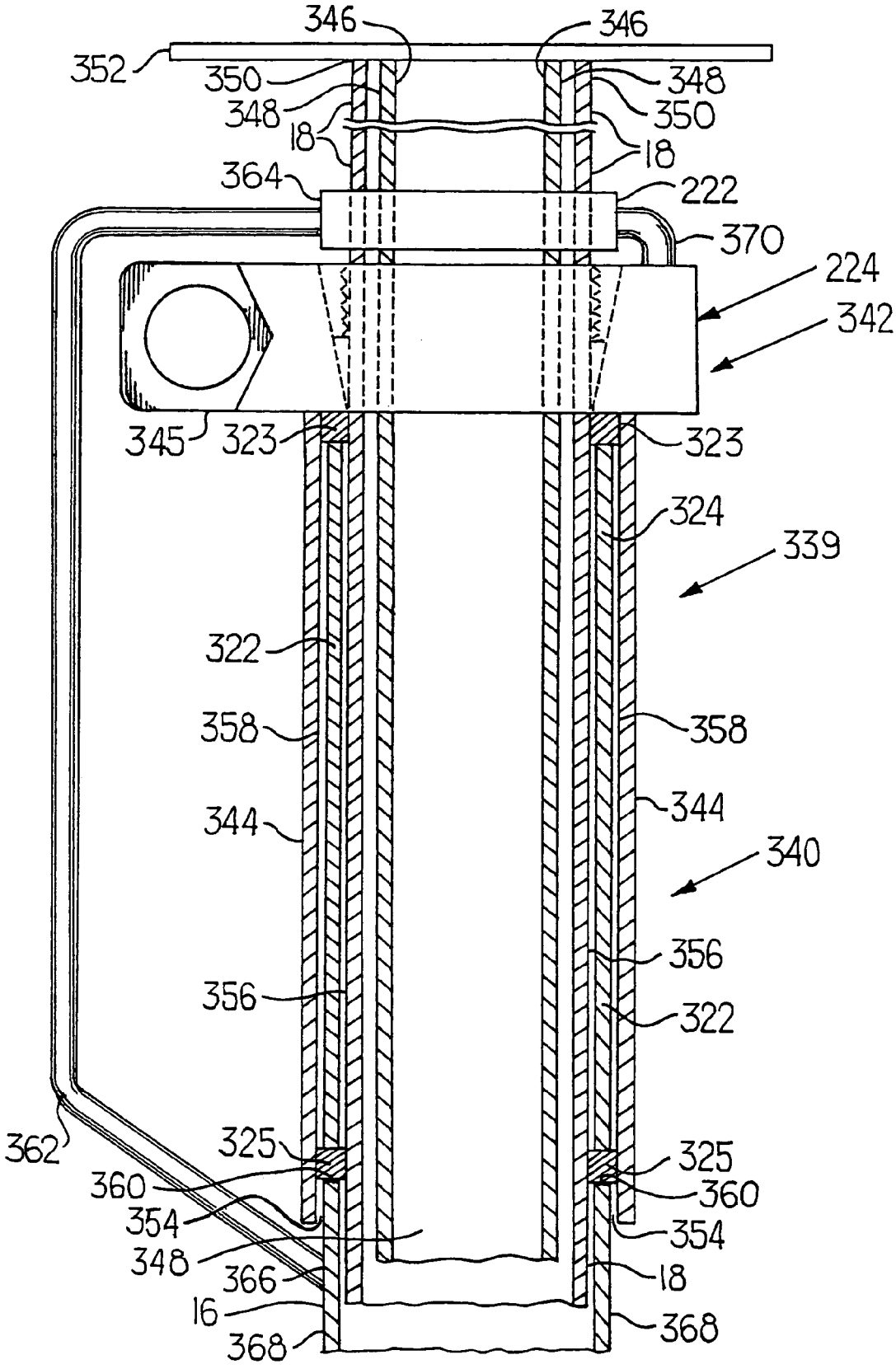
FIG. 22 is a sectional side view, in cross section, of a wedge and housing arrangement having the yield section of the invention adjacent the juncture of the first and second conduits.

With reference to FIG. 22 there is shown a yieldable prop 339 having another non-limiting embodiment of a yield section 340 of the invention at wedge and housing combination 342 and the juncture of the first and second conduits 16, 18. The yield section 340 includes, but is not limited to, a shroud 344 secured to surface 345 of the housing 224. End 346 of inner pipe 348 and end 350 of the second conduit 18 are welded to bearing plate 352 with the center axis of the inner pipe 348 and the second conduit 18 concentric with one another. The upper follower ring 323, the insert 322, and the lower follower ring 325 are positioned in space 354 between outer surface 356 of the second conduit 18 and inner surface 358 of the shroud 344. End 360 of the first conduit 16 is positioned in the space 354. A handle 362 has an end 364 secured to the collar 222 and the other end 366 secured to outer surface 368 of the first conduit 16 to secure components of the yield section 340 together in a similar manner as the handle 332 shown in FIG. 20 held the yield section 300 to the end of the first conduit 16. The collar 222 is attached to the housing 224 by handle 370 and a tie (not shown) similar to the tie 250 (see FIGS. 17*a* and 17*b*) maintains the second conduit 18 in the first conduit 16 as previously discussed.

As can be appreciated, the inner pipe 348 can be eliminated and the outer surface 356 of the second conduit 18 can be used to provide a wall for the space 354. The inner pipe 348 is recommended where the second conduit 18 is not considered to be strong enough to contain the insert 322 in the space 354 as it is compressed between the housing 342 and the first conduit 16. In those instances, the length of the inner pipe 348 is sufficient to extend from the bearing plate 352 beyond the shroud 344 when the yieldable prop is set in position between two opposing objects, e.g., a mine floor and a mine ceiling.

As can be appreciated, any type of clamping or securing arrangement may be used to maintain the first and second conduit of the yieldable prop 302 shown in FIG. 20 and the yieldable prop 339 shown in FIG. 22 in position provided that the clamping arrangement secures the first and second conduits together to prevent the second conduit from sliding into the first conduit when a load is applied to the bearing plates. Further, the yield section can be used in any orientation, e.g., adjacent to the mine ceiling or adjacent to the mine floor as shown in FIG. 20, or in between the first and second conduits as shown in FIG. 22. Further, the first conduit can be used as the upper conduit and the second conduit as the lower conduit. Still further, the yield section may be positioned on a bearing plate to receive the end of the second conduit, and the yield prop may have a yield section at each of the bearing plates.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

We claim:

1. A yieldable prop, comprising:

a hollow first conduit having a first end and an opposite second end;

a housing securely mounted on the outer surface of the first conduit at the first end of the first conduit, the housing having a conical-shaped interior surface, with interior diameter decreasing as distance from the first end of the first conduit increases, wherein the housing comprises a first end and an opposite second end, with the first and second ends of the housing in facing relationship to one another and joined together by a bolt and nut assembly;

a second conduit slidably mounted in the first end of the hollow first conduit;

at least two discrete engaging members in the first end of the housing, each of the at least two engaging members engaging the conical-shaped interior surface of the housing and the outer surface of the second conduit to prevent the second conduit from sliding into the hollow first conduit, while providing for movement of the first and second conduits away from one another, and a restraint arrangement comprising a ring on the outer surface of the second conduit and a handle having a first end portion secured to the ring and opposite second end portion secured to the outer surface of the hollow first conduit, wherein the at least two discrete engaging members are between the ring and the second end portion of the handle, and the restraint arrangement limits movement of the at least two discrete engaging members out of the conical-shaped interior surface of the hollow first conduit.

2. A method of setting up a yieldable prop, comprising:

providing a yieldable prop, comprising:

a hollow first conduit having a first end and an opposite second end, the first end having a conical-shaped interior surface, with interior diameter of the conical-shaped interior surface decreasing as distance from the first end of the hollow first conduit increases;

a second conduit slidably mounted in the first end of the hollow first conduit; and at least two engaging members in the first end of the hollow first conduit, each of the at least two engaging members in a first position applying a first predetermined pressure to the conical-shaped interior surface of the first conduit and outer surface of the second conduit, and in a second position applying a second predetermined pressure to the conical-shaped interior surface of the first conduit and outer surface of the second conduit, wherein the first predetermined pressure is greater than the second predetermined pressure, and a restraint arrangement comprising a one piece circular ring member mounted on outer surface of the second conduit and a handle, the handle comprising a first end portion, a second end portion and an elongated member connecting the first end portion and the second end portion, wherein the first end portion is secured to the ring member and the second end portion is secured to outer surface of the hollow first conduit; the at least two engaging members are between and spaced from the ring member and the second end portion of the handle, and wherein the restraint arrangement limits movement of the at least two engaging members out of the conical-shaped interior surface of the hollow first conduit, wherein the at least two engaging members are in the first position;

acting on the restraint arrangement to allow for movement of the at least two engaging members into the second position;

moving the first and second conduits away from one another to move the at least two engaging members into the second position and to expand the yieldable prop to a first predetermined length; and moving the first and second conduits toward one another to move the at least two engaging members into the first position and to set the yieldable prop to a second predetermined length.

3. The method according to claim 2, wherein the second predetermined length is less than the first predetermined length.

4. A yieldable prop, comprising:

a hollow first conduit having a first end and an opposite second end, the first end having a conical-shaped interior surface, with interior diameter decreasing as distance from the first end of the first conduit increases;

a second conduit slidably mounted in the first end of the hollow first conduit;

at least two discrete engaging members in the first end of the hollow conduit, each of the at least two engaging members engaging the conical-shaped interior surface and outer surface of the second conduit to prevent the second conduit from sliding into the hollow first conduit, while providing for movement of the first and second conduits away from one another, and a restraint arrangement comprising a one piece circular ring member mounted on outer surface of the second conduit and a handle, the handle comprising a first end portion, a second end portion and an elongated member connecting the first end portion and the second end portion, wherein the first end portion is secured to the ring member, and the second end portion is secured to outer surface of the hollow first conduit; the at least two discrete engaging members are between and spaced from the ring member and the second end portion of the handle, and wherein the restraint arrangement limits movement of the at least two discrete engaging members out of the conical-shaped interior surface of the hollow first conduit.

5. The yieldable prop according to claim 4, wherein each of the at least two discrete engaging members comprises a major surface contoured to engage the conical-shaped interior surface, and a second opposite major surface contoured to engage an outer surface of the second conduit.

6. The yieldable prop according to claim 4, wherein the conical-shaped interior surface is interior surface of a housing securely mounted on the outer surface of the first conduit at the first end of the first conduit.

7. The yieldable prop according to claim 4, wherein the restraint arrangement and the at least two members prevent the first and second conduits from moving toward, and away from, one another.

8. The yieldable prop according to claim 4 wherein the conical-shaped interior surface is first portion of interior surface of a housing, the interior surface of the housing further comprising a circular second portion, wherein the housing is mounted at the first end of the first conduit.

9. The yieldable prop according to claim 8 wherein the second portion of the interior surface of the housing is in facing relationship to the outer surface of the second conduit.

10. A yieldable prop, comprising:

a hollow first conduit having a first end and an opposite second end, the first end having a conical-shaped interior surface, with interior diameter decreasing as distance from the first end of the first conduit increases;

a second conduit slidably mounted in the first end of the hollow first conduit;

at least two discrete engaging members in the first end of the hollow conduit, each of the at least two engaging members engaging the conical-shaped interior surface and the outer surface of the second conduit to prevent the second conduit from sliding into the hollow first conduit, while providing for movement of the first and second conduits away from one another:

a restraint arrangement comprising a ring on outer surface of the second conduit and a handle having a first end portion secured to the ring and opposite second end portion secured to the outer surface of the hollow first conduit, wherein the at least two discrete engaging members are between the ring and the second end portion of the handle, and the restraint arrangement limits movement of the at least two discrete engaging members out of the conical-shaped interior surface of the hollow first conduit, and a band around the outer surface of the second conduit between the ring of the restraint arrangement and the at least two discrete engaging members.

* * * * *